US007584848B2

(12) United States Patent
Yoshifusa

(10) Patent No.: US 7,584,848 B2
(45) Date of Patent: Sep. 8, 2009

(54) STRUCTURE OF AIR-PACKING DEVICE

(75) Inventor: Kark K. Yoshifusa, Lake Forest, CA (US)

(73) Assignee: Air-Paq, Inc., Las Vegas, NV (US)

( * ) Notice: Subject to any disclaimer, the term of this patent is extended or adjusted under 35 U.S.C. 154(b) by 549 days.

(21) Appl. No.: 11/297,969

(22) Filed: Dec. 9, 2005

(65) Prior Publication Data

US 2007/0163916 A1 Jul. 19, 2007

(51) Int. Cl.
*B65D 81/02* (2006.01)

(52) U.S. Cl. ..... 206/522; 206/592; 383/3

(58) Field of Classification Search ..... 206/521, 206/522, 591, 594, 592, 593; 383/3, 37, 383/87, 39, 40, 66; 428/166, 178, 188; 410/119
See application file for complete search history.

(56) References Cited

U.S. PATENT DOCUMENTS 5,469,966 A 11/1995 Boyer
5,826,723 A 10/1998 Jaszai
6,629,777 B2 10/2003 Tanaka et al.
7,165,677 B2 * 1/2007 Tanaka et al. ..... 206/522
2002/0064319 A1 * 5/2002 Tanaka et al. ..... 383/3
2005/0109656 A1 * 5/2005 Ishizaki ..... 206/522
2005/0189257 A1 * 9/2005 Chen et al. ..... 206/522
2005/0263425 A1 * 12/2005 Tanaka et al. ..... 206/522
2006/0032779 A1 * 2/2006 Tanaka et al. ..... 206/522
2007/0051655 A1 * 3/2007 Yoshifusa ..... 206/522
2007/0065047 A1 * 3/2007 Kojima et al. ..... 383/3

* cited by examiner

*Primary Examiner*—David T Fidei
(74) *Attorney, Agent, or Firm*—Finnegan, Henderson, Farabow, Garrett & Dunner, LLP

(57) ABSTRACT

An air-packing device has an improved shock absorbing capability to protect a product in a container box. The air-packing device is comprised of first and second thermoplastic films where predetermined portions are bonded thereby creating a plurality of air containers, a plurality of heat-seal lands each sealing the first and second thermoplastic films in a small area of the air container thereby creating a plurality of series connected air cells for each air container, a plurality of check valves for corresponding air containers for allowing the compressed air to flow in a forward direction. A bendable flap portion is created that facilitates opening and closing operations so that a product to be protected can be easily placed or removed.

20 Claims, 24 Drawing Sheets

STRUCTURE OF AIR-PACKING DEVICE

FIELD OF THE INVENTION

This invention relates to a structure of an air-packing device for use as packing material, and more particularly, to a structure of an air-packing device and check valves incorporated therein for achieving an improved shock absorbing capability to protect a product from a shock or impact by packing the product within a space having a shape unique to the product while allowing easy placement and takeout of the package.

BACKGROUND OF THE INVENTION

In product distribution channels such as product shipping, a Styrofoam packing material has been used for a long time for packing commodity and industrial products. Although the styrofoam package material has a merit such as a good thermal insulation performance and a light weight, it has also various disadvantages: recycling the styrofoam is not possible, soot is produced when it burns, a flake or chip comes off when it is snagged because of it's brittleness, an expensive mold is needed for its production, and a relatively large warehouse is necessary to store it.

Therefore, to solve such problems noted above, other packing materials and methods have been proposed. One method is a fluid container of sealingly containing a liquid or gas such as air (hereafter also referred to as an "air-packing device"). The air-packing device has excellent characteristics to solve the problems involved in the styrofoam. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported with low cost.

FIG. 1 shows an example of structure of an air-packing device in the conventional technology. The air-packing device 20 includes a plurality of air containers 22 and check valves 24, a guide passage 21 and an air input 25. The air from the air input 25 is supplied to the air containers 22 through the air passage 21 and the check valves 24. Typically, the air-packing device 20 is composed of two thermoplastic films which are bonded together at bonding areas 23*a*.

Each air container 22 is provided with a check valve 24. One of the purposes of having multiple air containers with corresponding check valves is to increase the reliability, because each air container is independent from the others. Namely, even if one of the air containers suffers from an air leakage for some reason, the air-packing device can still function as a shock absorber for packing the product because other air containers are still inflated because of the corresponding check valves.

FIG. 2 is a plan view of the air-packing device 20 of FIG. 1 when it is not inflated which shows bonding areas for closing two thermoplastic films. The thermoplastic films of the air-packing device 20 are bonded (heat-sealed) together at bonding areas 23*a* which are rectangular periphery thereof to air tightly close the air-packing device 20. The thermoplastic films of the air-packing device 20 are also bonded together at bonding areas 23*b* which are boundaries of the air containers 22 to air-tightly separate the air containers 22 from one another.

When using the air-packing device, each air container 22 is filled with the air from the air input 25 through the guide passage 21 and the check valve 24. After filling the air, the expansion of each air container 22 is maintained because each check-valve 24 prevents the reverse flow of the air. The check valve 24 is typically made of two small thermoplastic films which are bonded together to form an air pipe. The air pipe has a tip opening and a valve body to allow the air flowing in the forward direction through the air pipe from the tip opening but the valve body prevents the air flow in the backward direction.

Air-packing devices are becoming more and more popular because of the advantages noted above. There is an increasing need to store and carry precision products or articles which are sensitive to shocks and impacts often involved in shipment of the products. There are many other types of product, such as wine bottles, DVD drivers, music instruments, glass or ceramic wares, antiques, etc. that need special attention so as not to receive a shock, vibration or other mechanical impact. Thus, it is desired that the air-packing device protects the product to minimize the shock and impact. An air-packing structure is desired that can securely hold a package to be protected while facilitating easy placement of the package.

SUMMARY OF THE INVENTION

It is, therefore, an object of the present invention to provide a structure of an air-packing device for packing a product that can minimize a shock or vibration and protect the product.

It is another object of the present invention to provide a structure of an air-packing device for packing a product by a packing space created by the air-packing device through a top opening which is designed to easily open and close the air-packing device.

In one aspect of the present invention, an air-packing device inflatable by compressed air for protecting a product therein when stored in a container box, comprising: first and second thermoplastic films superposed with each other where predetermined portions of the first and second thermoplastic films are bonded, thereby creating a plurality of air containers; a plurality of heat-seal lands each sealing the first and second thermoplastic films in a small area of the air container in a manner to allow air flow between the air cells, thereby creating a plurality of series connected air cells for each air container; a plurality of check valves for corresponding air containers established between the first and second thermoplastic films for allowing the compressed air to flow in a forward direction; an air input commonly connected to the plurality of check valves to supply the compressed air to all of the air cells through the check valves. A part of a set of the air cells at one end of the air-packing device and a part of a set of the air cells at another end of the air-packing device are not bonded to create a top opening having a pair flap portions symmetrical with one another to open and close the air-packing device.

In another aspect, a most part a set of the air cells at one end of the air-packing device is not bonded to create a top opening having a flap portion to open and close the air-packing device, and wherein an end of the flap portion comes under the air cells at another end when the air-packing device is closed.

The heat-seal lands at the bottom of the air-packing device promote to downwardly bend the air-packing device, thereby widely opening the top opening for installing a product therein or removing the product therefrom.

The air-packing device made of the first and second thermoplastic films with the air containers and air cells is first produced in a sheet like form, and is then folded in a predetermined manner and bonded at predetermined locations to create a three dimensional shape for packing a particular product therein.

According to the present invention, the air-packing device forms a flap portion that allows a user to easily enlarge the opening of the air-packing device for placement and removal of the package to be protected. The structure of the air-packing device under the present invention allows to securely hold the package in the air-packing device. Reliability is improved due to check valves that are provided to each air container.

BRIEF DESCRIPTION OF THE DRAWINGS

FIG. 3A shows air-packing device without a product and FIG. 3B shows the air-packing device in which a product to be protected is placed therein.

FIG. 4A shows the steady state thereof without a product therein and FIG. 4B shows the situation where flaps are opened for placing the product therein and taking out the product therefrom.

FIG. 5A shows the air-packing device without the product and FIG. 5B shows the air-packing device having the product to be protected therein.

FIG. 12A shows a cross sectional plan view of the check valve, FIG. 12B shows a cross sectional side view thereof.

FIG. 14A is a plan view showing a structure of a check valve on an air-packing device, FIG. 14B is a plan view showing the check valve including flows of air when a compressed air is supplied thereto, FIG. 14C is a plan view showing the portions for bonding the check valve sheet to a thermoplastic film of the air-packing device, and FIG. 14D is a plan view showing the portions for bonding the check valve sheet and the two plastic films of the air-packing device.

FIG. 17A shows air flows in the air cells of the air-packing device when being inflated, and FIG. 17B shows a situation where the air-packing device is fully inflated and the check valve is closed.

DETAILED DESCRIPTION OF THE INVENTION

The air-packing device of the present invention will be described in more detail with reference to the accompanying drawings. It should be noted that although the present invention is described for the case of using an air for inflating the air-packing device for an illustration purpose, other fluids such as other types of gas or liquid may also be used. The air-packing device is typically used in a container box to pack a product during the distribution channel of the product.

A first embodiment of the air-packing device according to the present invention is described with reference to FIG. 3A-3B, 4A-4B, 5A-5B, 7 and 7A-7D. This embodiment of the air-packing device can be advantageously used to pack a product having a substantially flat box shape, such as a notebook computer, a DVD player, etc. The air-packing device of the present invention is designed to have a top opening which allows easily opening and closing operations for installing or removing the product to be protected through the top opening.

Figure 1:
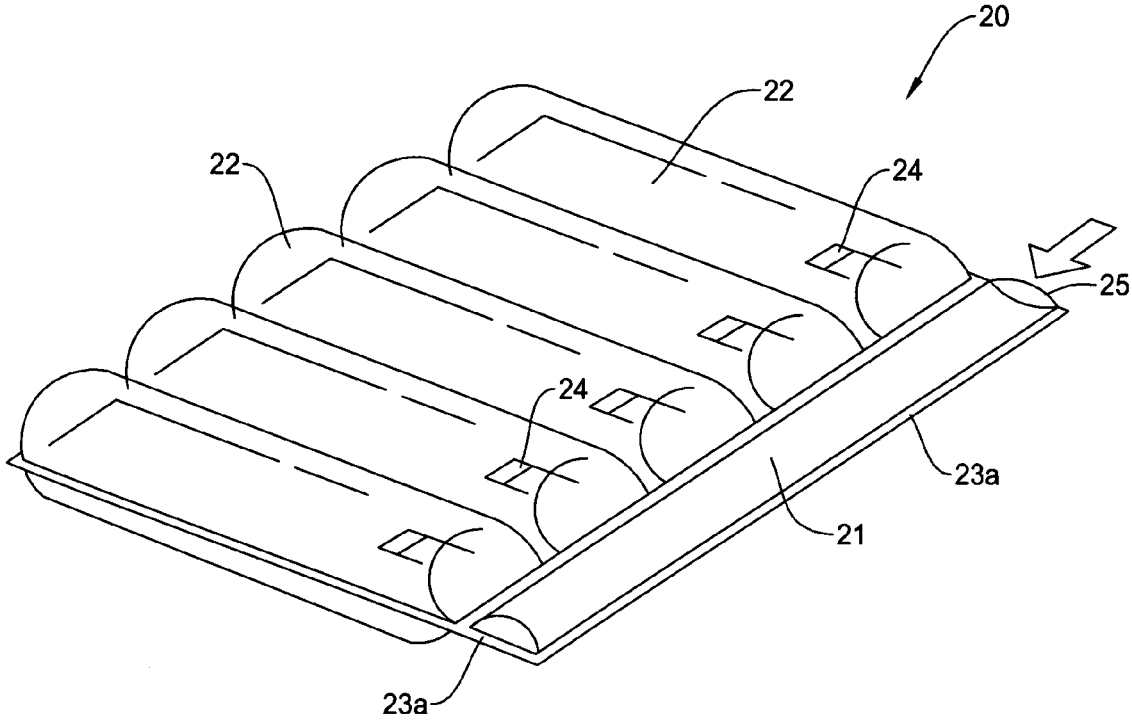
FIG. 1 is a schematic perspective view showing an example of basic structure of an air-packing device in the conventional technology.
Figure 2:
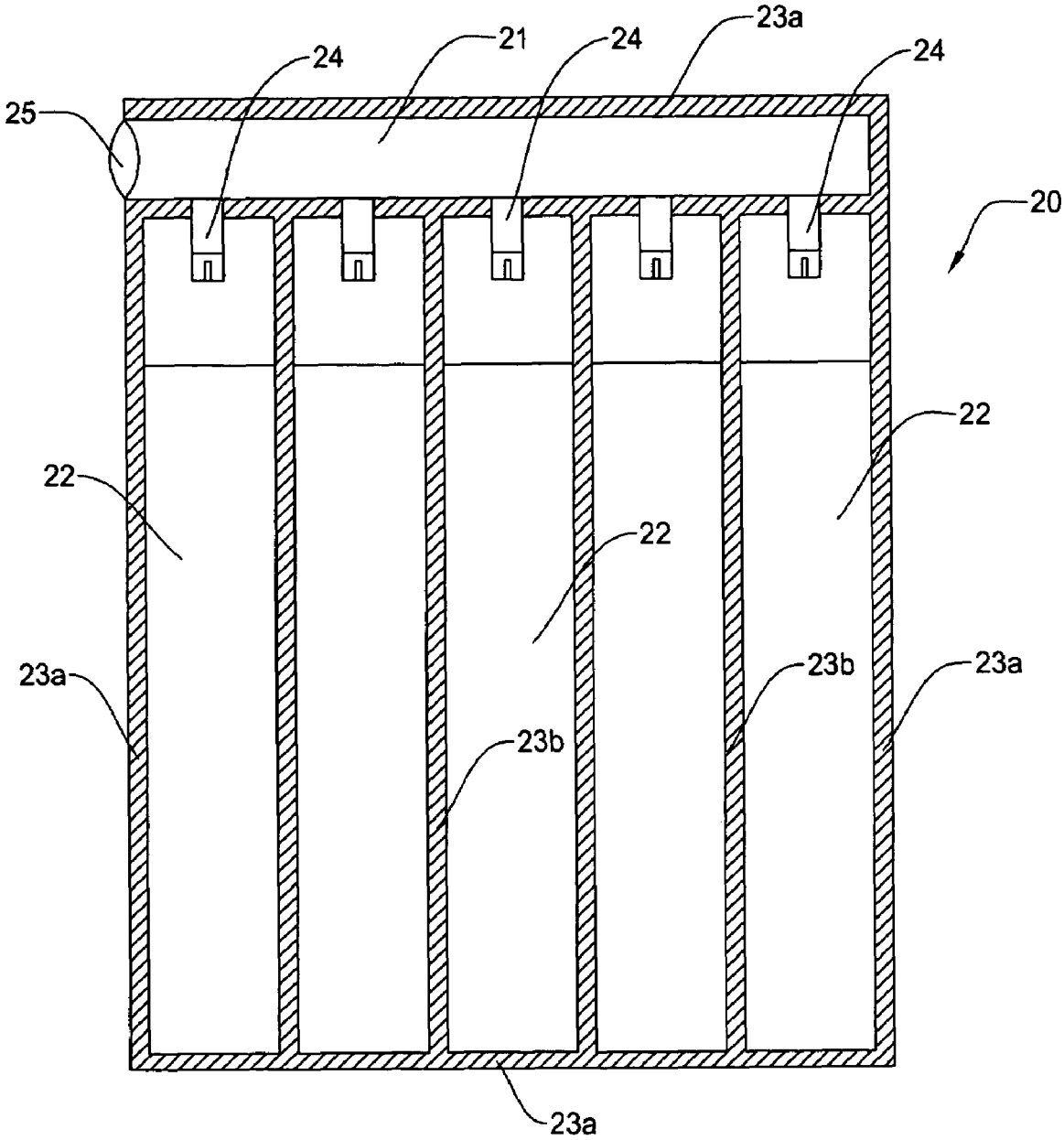
FIG. 2 is a plan view of the air-packing device 20 of FIG. 1 when it is not inflated for showing bonding areas for closing two thermoplastic films.
Figure 3A:
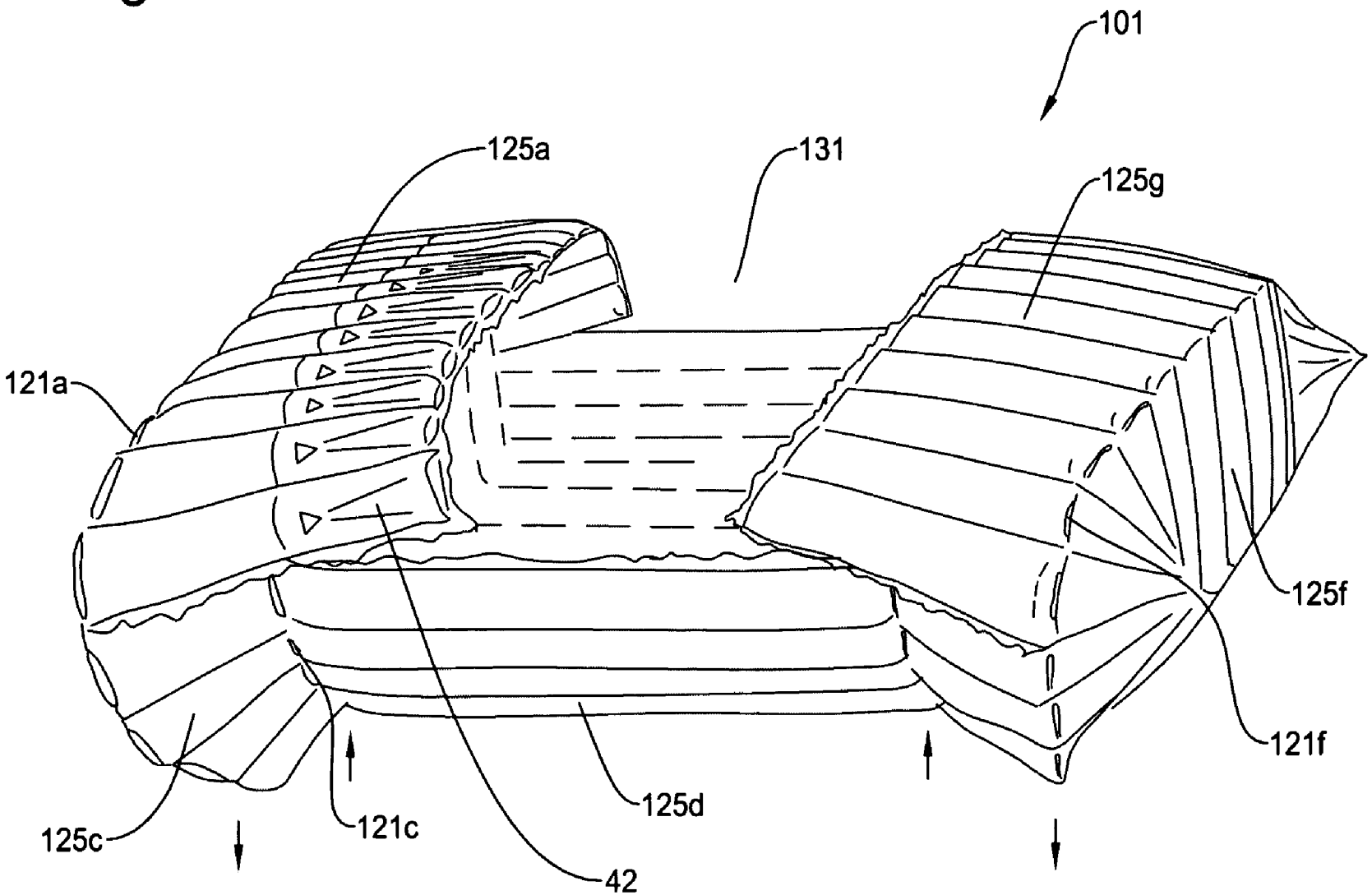
FIGS. 3A and 3B are perspective views showing an example of structure of the air-packing device of the present invention where

FIG. 3A is a perspective view of an air-packing device 101 which is inflated by the compressed air but a product to be protected is not placed therein. The air-packing device 101 has a top opening 131 through which a product or a package having the product is introduced to the inner space. FIG. 3A shows the situation where the air-packing device is slightly opened at the top from the steady state.

Figure 6:
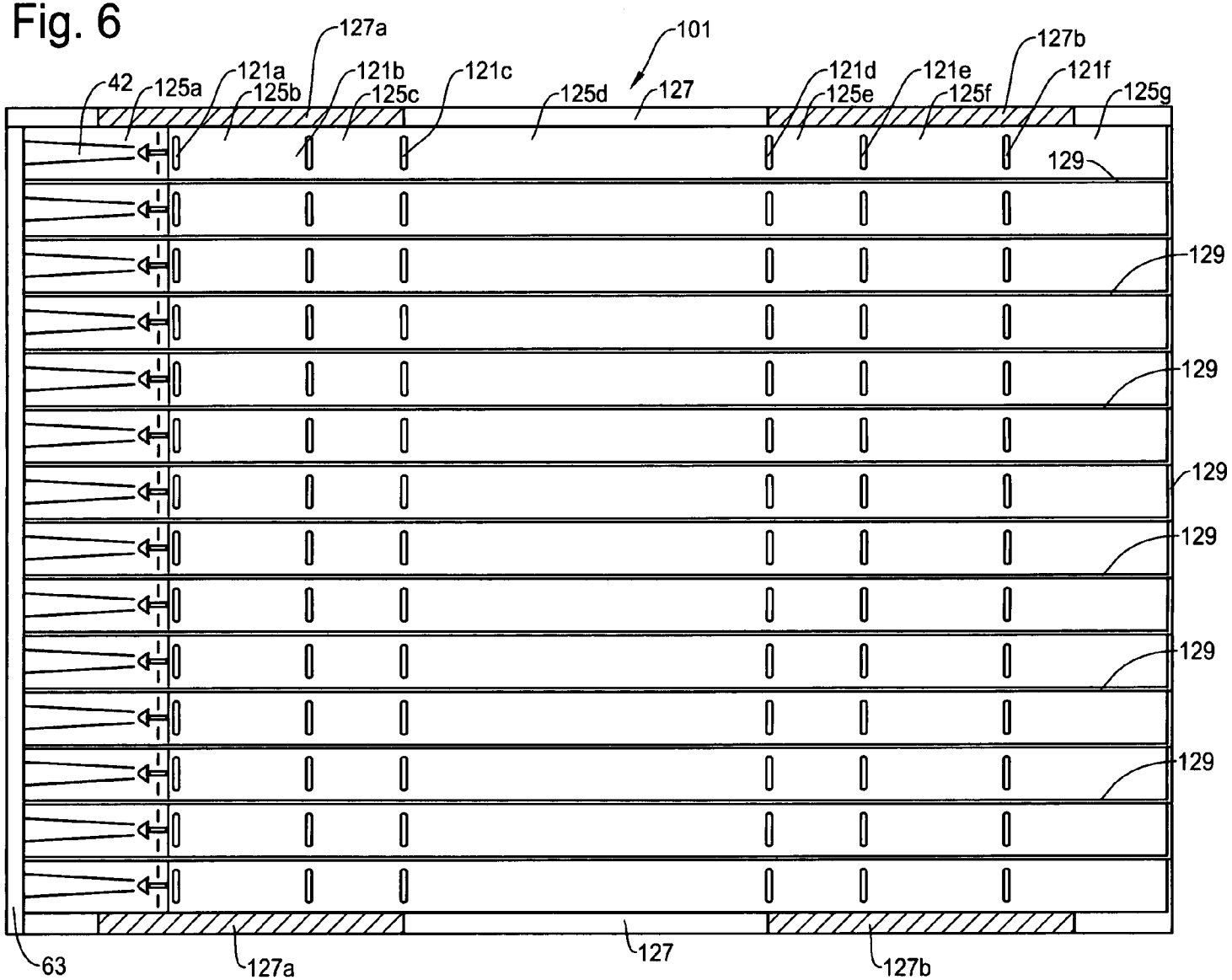
FIG. 6 is a plan view showing a sheet form of the air-packing device of the present invention which is not inflated and is not folded or bonded to form the structure shown in FIGS. 3A-3B, 4A-4B and 5A-5B.

Typically, the air-packing device 101 is configured by a plurality of air-containers where each air-container has a plurality of air cells 125*a*-125*g* connected in series. The air-packing device 101 is first produced in a sheet like form as shown in FIG. 6 and is folded and bonded through the process of FIGS. 7A-7D. Then, by supplying the compressed air, the air-packing device is inflated to a generally cubic shape of FIG. 3A for packing the product therein.

Reference is now made to a plan view of FIG. 6 which shows a sheet like form of the uninflated air-packing device 101 to describe its overall structure and components thereof. The air-packing device 101 is created by bonding two sheets of thermoplastic films. Each of the thermoplastic films is typically made of three layers of materials: polyethylene, nylon and polyethylene which are bonded together with appropriate adhesive. The nylon is provided between the polyethylene to increase the physical strength of the thermoplastic film.

The two thermoplastic films are bonded (heat-sealed) at separation seals 129, side seals 127, and the heat-seal lands 121 shown in FIG. 6. The separation seals 129 air-tightly separate the thermoplastic films to create a plurality of air containers 125 each having a check valve 42. In a later heat-seal process for forming the three dimensional structure of the air-packing device, the side seals 127 are further heat-sealed at bonding (heat-seal) areas 127*a* and 127*b* after folding the air-packing device 101 in the manner shown in FIGS. 7A-7D.

In this example, the check valve 42 is formed at the left end of each air container 125 where an air input 63 is commonly connected to all of the check valves 42 to supply the compressed air. The check valve 42 is an air valve that prevents reverse flow of the compressed air. Since the check valve 42 is provided to each air container 125, the air containers 125 of the air-packing device 101 can hold the air (fluid) independently from each other.

A plurality of heat-seal lands 121*a*-121*f* are provided within each air container 125 so that the two thermoplastic films of each air container are bonded to one another. Thus, each of the heat-seal lands 121*a*-121*f* partially blocks the flow of air, although the air can pass through the space at both sides of the heat-seal land 121 within the same air container. As a result, each air container 125 is partially separated by the heat-seal lands 121*a*-121*f* to create a plurality of air cells 125*a*-125*g* which has a sausage like shape when inflated by the compressed air.

Since the two thermoplastic films are bonded at each of the heat-seal lands 121*a*-121*f* so that the thermoplastic films at the heat-seal lands 121*a*-121*f* will not inflate, the heat-seal lands 121*a*-121*f* are used for folding the air packing device 101 to a desired shape. As noted above, since each strip of the air container 125 has its own check valve 42, the air containers 125*a*-125*g* are independent from one another. That is, even if one air container 125 is punctured, the other air containers 125*a*-125*g* are not affected, thereby improving reliability of the air packing device 101. The check valve 42 that can be advantageously implemented in the present invention will be described later in detail with reference to FIGS. 12A-17B.

As noted above, each heat-seal land 121 divides the air container 125 to create a plurality of air cells 125*a*-125*g*. For example, with respect to each air container 125, the heat-seal land 121*a* forms the air cell 125*a*, the heat-seal land 121*b* forms the air cell 125*b*, and the heat-seal land 121*c* forms the air cell 125*c*, and so forth. The sheet like form of the air-packing device 101 is folded and a heat-seal process is conducted to bond predetermined portions thereof for creating a three dimensional structure of FIGS. 3A-3B, 4A-4B and 5A-5B.

Referring back to FIG. 3A, the inflated air packing device 101 has a box-like shape with an opening 131, through which the product to be protected is inserted or removed. As noted above, since the thermoplastic films are bonded at the heat-seal lands 121, the air-packing device 101 are easily folded at the heat-seal lands 121 as folding points. FIG. 3A shows the condition where the air-packing device 101 is forcefully bent at both sides of the bottom by user's hands as shown by arrows. As a result, each of the air cells 125*a* and 125 at both ends works as a flap so that the size of the top opening 131 is increased to easily insert the product in an inner space of the air-packing device.

Figure 3B:
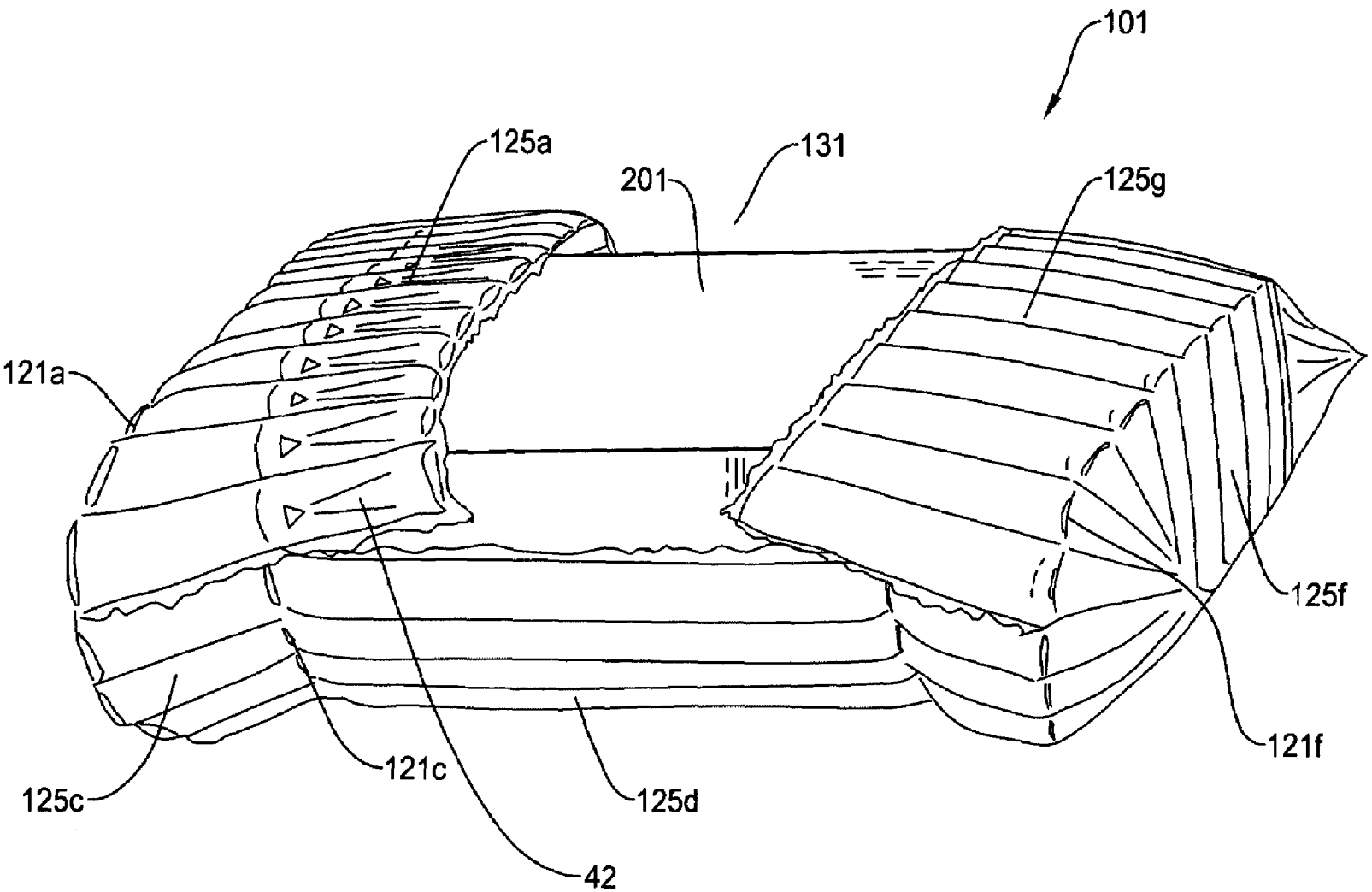

FIG. 3B is a perspective view similar to FIG. 3A, except that a product 201 to be protected is placed inside of the air packing device 101, and thus, the bottom is returned to the steady condition. The product 201 is snugly packed within the inner space of the air packing device 101. In this example, the product 201 has a substantially flat box shape and its outer surfaces contact with the air cells 125*a*-125*g* of the air packing device 101. Typically, the air-packing device 101 having the product 201 therein is further installed in a container box, made of hard paper, corrugated fiber board, etc., commonly used in the industry. Therefore, the product 201 is protected from the shock and vibration.

Figure 4A:
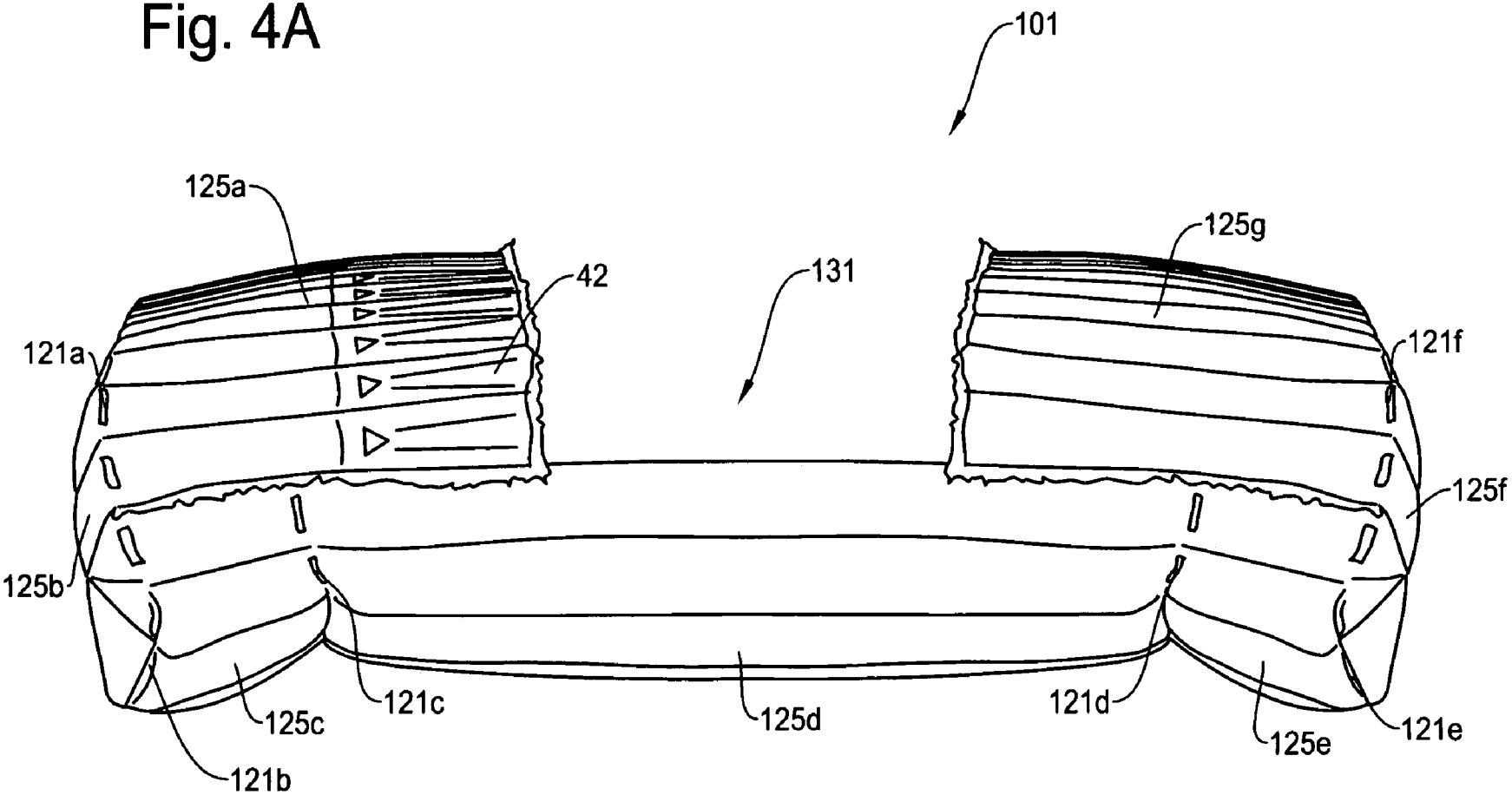
FIGS. 4A and 4B are front view showing the situation for opening the top of the air-packing device of the present invention where
Figure 4B:
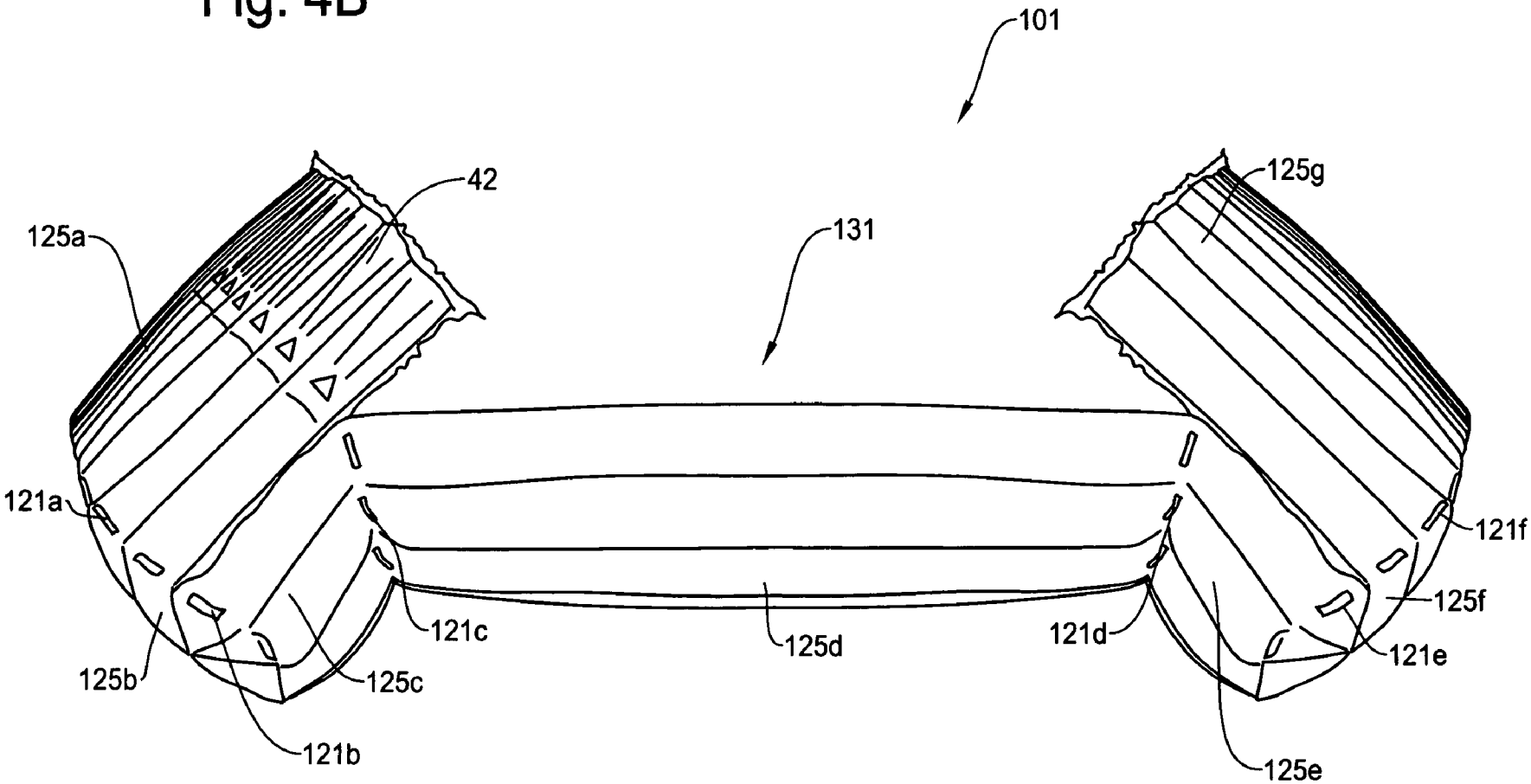

FIGS. 4A and 4B are front views of the inflated air-packing device 101 of the present invention. FIG. 4A shows the condition where the top opening 131 of the air packing device 101 is "closed" in the steady state. FIG. 4B shows the condition wherein the top opening 131 of the air packing device 101 is "opened" for installation or removal of the product. In this example, the left side of the air-packing device 101 is configured by the air cells 125*a*, 125*b*, and 125*c*, and the right side of the air packing device 101 comprises the air cells 125*g*, 125*f*, and 125*e* where the bottom portion is connected by the air cell 125*d*.

As shown in FIG. 4B, when increasing the size of the top opening 131, the heat-seal lands 121*c* and 121*d* at the bottom allow user to easily bend the air-packing device 101 downwardly as the folding points. As a result, the air-packing device 101 is widened at the top opening 131 to easily place a product to be protected therein or to easily take out the product therefrom. Thus, the air-packing device 101 is able to hold the package securely while allowing easy placement and removal of the product.

Figure 5A:
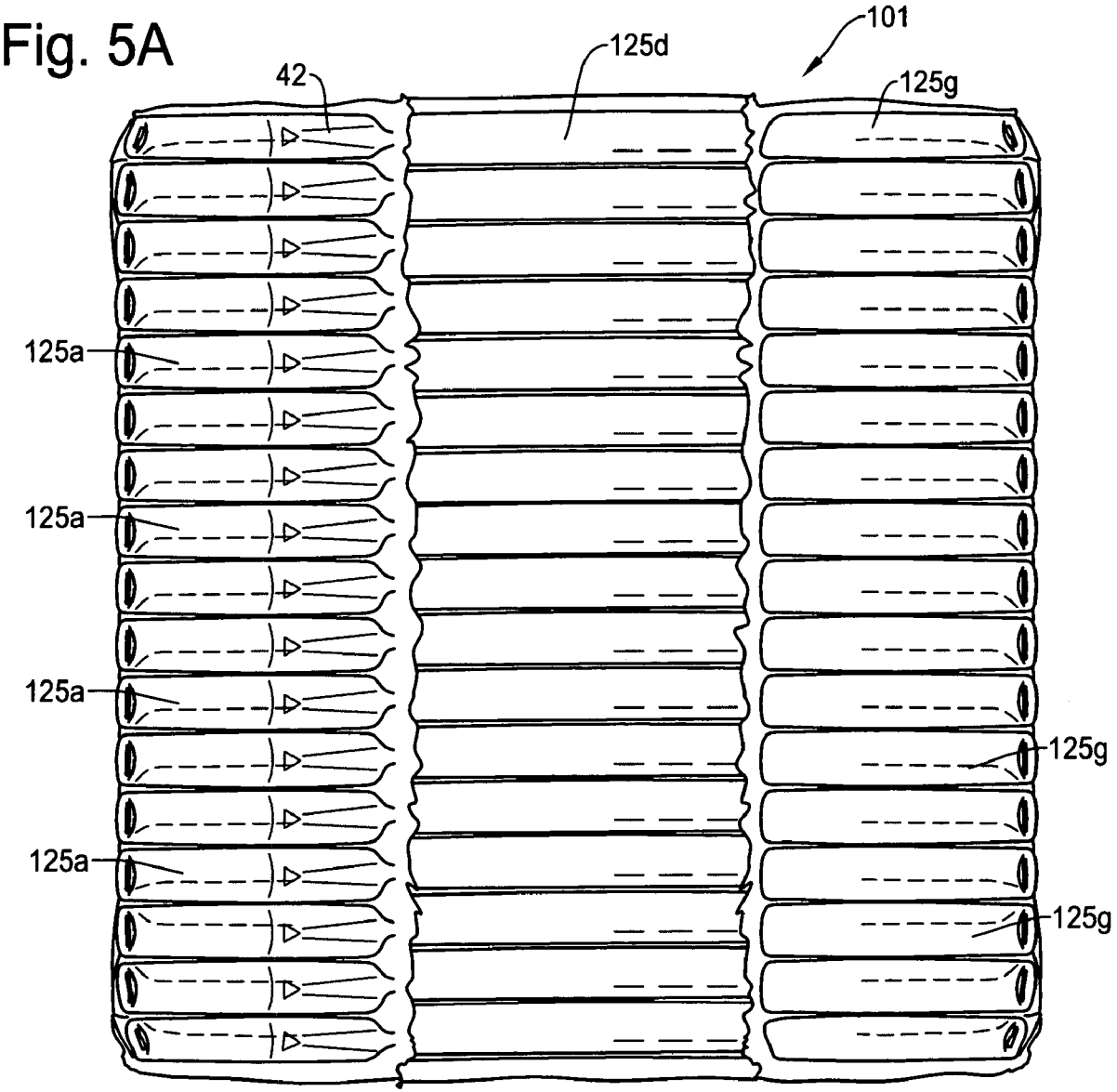
FIGS. 5A and 5B are top views showing an example of structure of the air-packing device of the present invention where
Figure 5B:
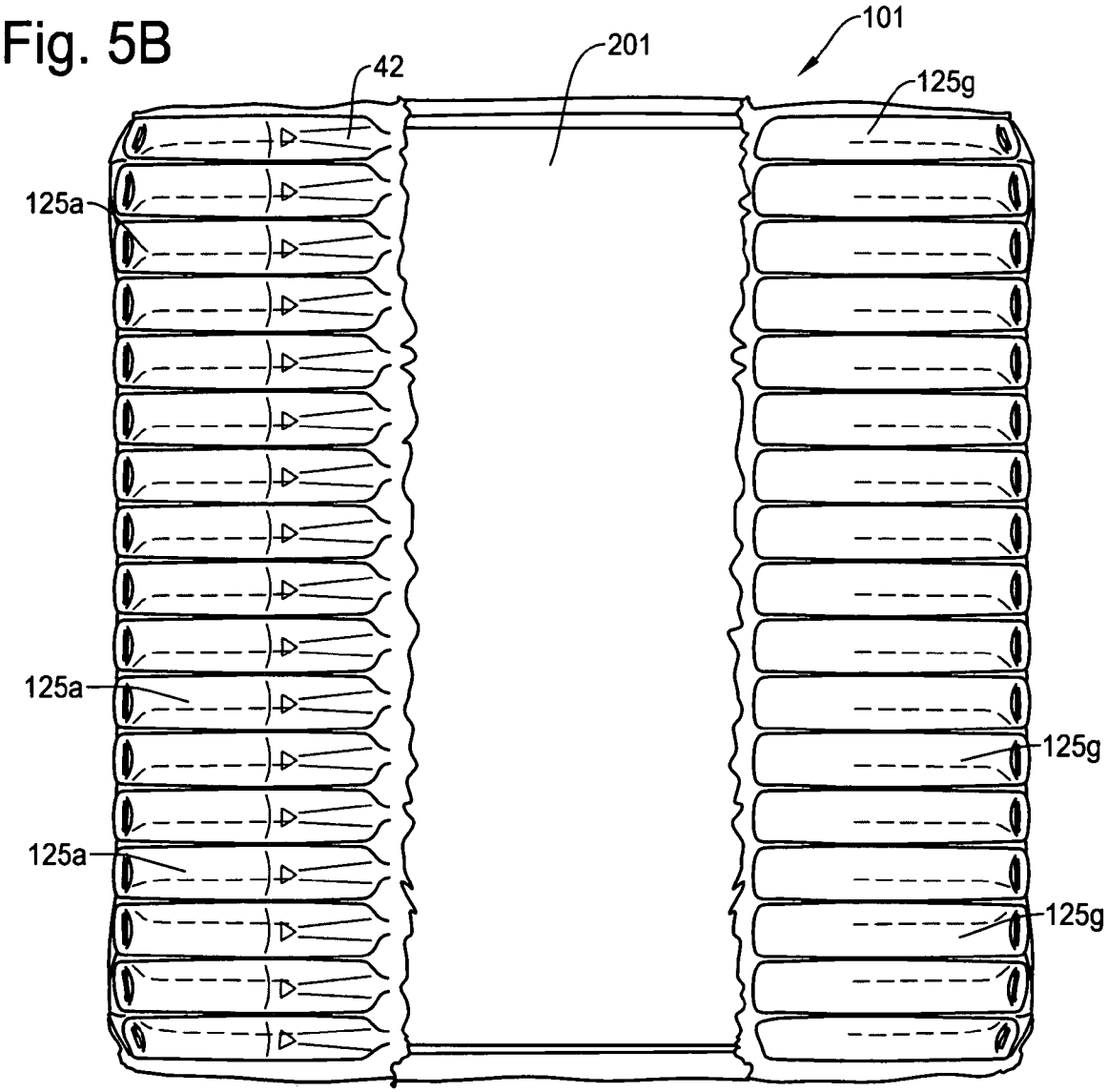

FIGS. 5A and 5B are top views showing the structure of the air-packing device 101 of the present invention which is inflated by the compressed air. FIG. 5A shows the condition where the air-packing device 101 does not contain a product to be protected therein such as shown in FIG. 3A. FIG. 5B shows the condition where the air-packing device 101 contains a product 201 to be protected therein such as show in FIG. 3B.

As noted above, the sheet like form of the air-packing device 101 shown in FIG. 6 is folded and a heat-seal process is conducted to bond the predetermined portions of the air-packing device 101 for creating the three dimensional structure of FIGS. 3A-5B. Such a procedure of folding and bonding the sheet of the air-packing device 101 of FIG. 6 is explained with reference to FIGS. 7A-7D. FIGS. 7A-7D are schematic cross sectional front views of the air-packing device 101 before being inflated by the compressed air. In FIGS. 7A-7D, the check valves 42 are omitted for simplicity of illustration.

Figure 7A:
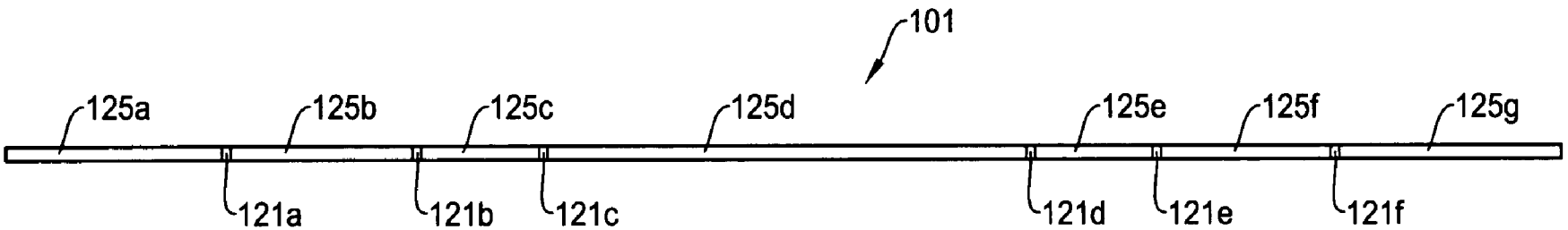
FIGS. 7A-7D are cross sectional front views showing the process for forming the air-packing device from the sheet form shown in FIG. 6 to the form of FIGS. 3A-3B, 4A-4B and 5A-5B by folding and bonding the predetermined portions of the air-packing device where the air-packing device in FIGS. 7A-7D is not inflated by the air.
Figure 7B:
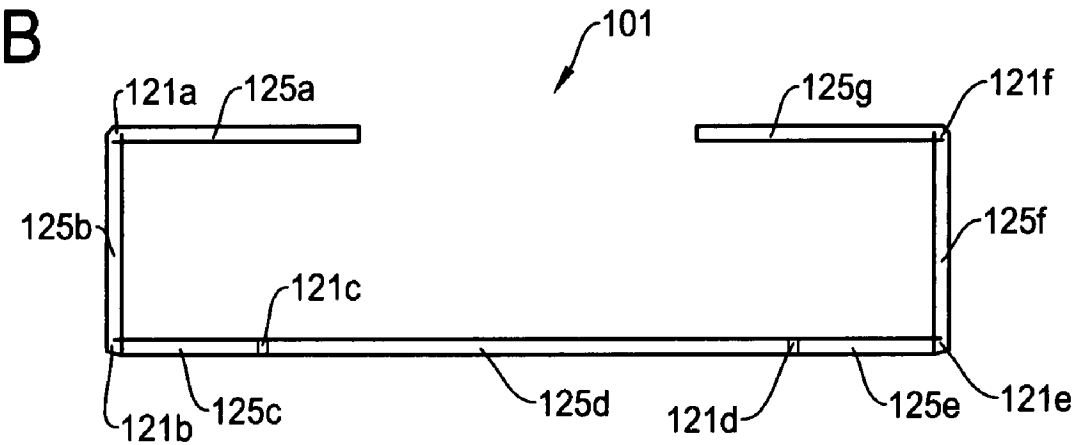

FIG. 7A shows the condition where the sheet form of the air-packing device 101 lies flat. FIG. 7B shows the condition where the air packing device 101 is folded at the heat-seal lands 121*a*, 121*b*, 121*f* and 121*e*. The heat-seal lands 121*c* and 121*d* are straight and not bent unlike other heat-seal lands. In reality, since the air-packing device 101 is not inflated, it can be bent in any form without regard to the locations of the heat-seal lands 121. However, it should be noted that, to show the relationship between the folding process and the final structure of the air-packing device 101, shapes (ex. bending points) shown FIGS. 7A-7D are exaggerated.

Figure 7C:
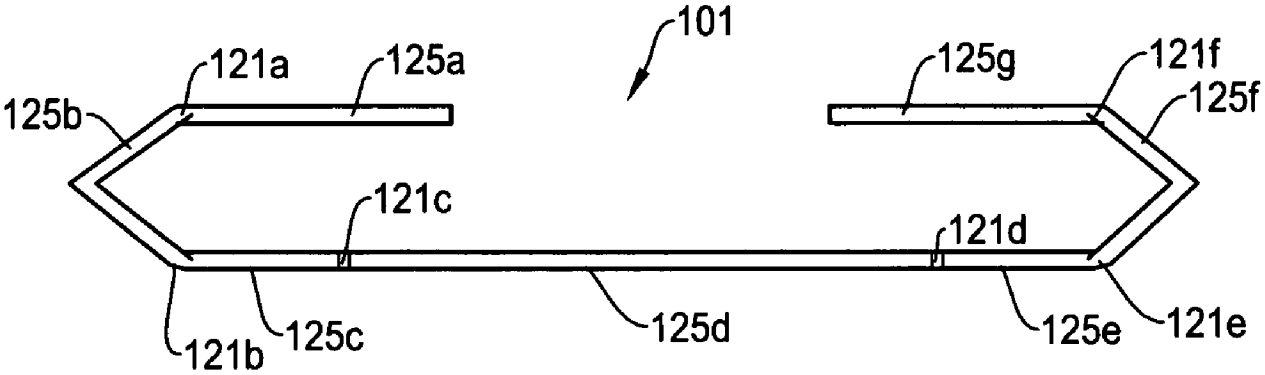
Figure 7D:
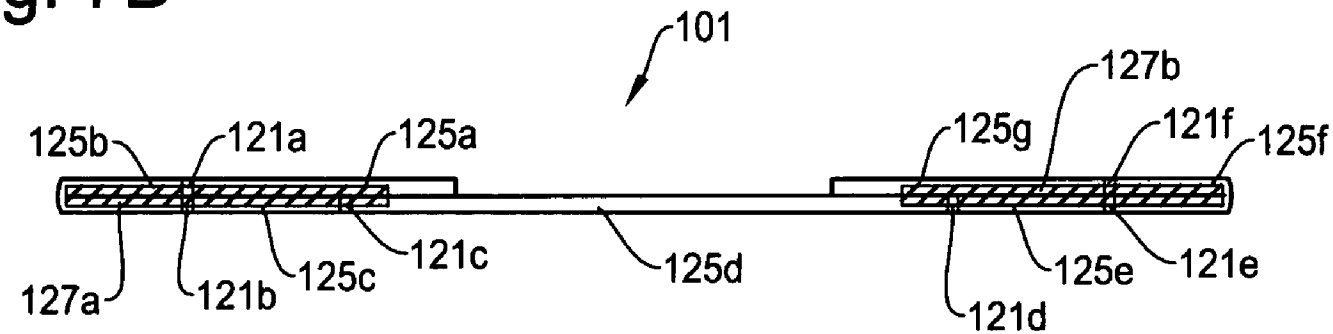

FIG. 7C shows the condition where the air-packing device 101 is further bent at the middle section of the air cells 125*b* and 125*f*. FIG. 7D shows the condition where the air-packing device 101 is completely bent flatly to perform a heat-seal process. When folded in the manner of FIG. 7D, the heat-seal areas 127*a* (see also FIG. 6) at each side of the air-packing device 101 are bonded with each other in such a way that the heat-seal area 127*a* extending along the sidemost air cells 125*a*, 125*b* and 125*c* is bonded. Similarly, the heat-seal areas 127*b* (see also FIG. 6) at each side of the air-packing device 101 are bonded with each other in such a way that the heat-seal area 127*b* extending along the sidemost air cells 125*g*, 125*f* and 125*e* is bonded.

Therefore, a pocket like space is created at each of the left end and the right end of the air-packing device 101. Preferably, an end portion of the air cells 125*a* (flap portion) and an end portion of the air cells 125*g* (flap portion) are not bonded in the above heat-sealing process so that the end portions promote to easily open the air-packing device 101 as shown in FIG. 4B. When the air packing device 101 shown in FIG. 7D is inflated by supplying the compressed air, the air packing device 101 takes the form shown in FIGS. 3A-3B, 4A-4B and 5A-5B.

It should be noted that the number of the air containers 125 and the number of air cells 125*a*-125*g* for each air container may vary to better accommodate a particular product to be protected. In the foregoing example, the flap portions (air cells 125*a* and 125*g*) cover a part of the product shown in FIG. 5B and has a relatively large opening at the top of the air-packing device 101. However, the size of the flap portion (air cells 125*a* and 125*g*) for forming the top opening 131 can be changed such that a whole product will be enclosed by the air-packing device 101.

A second embodiment of the air packing device under the present invention is explained next with reference to FIGS. 8A-8C, 9, 10 and 11A-11D. The second embodiment is suited for packing a product having a generally cylindrical shape such as a bottle although it can effectively pack other product as well. In the second embodiment, the air-packing device 201 is configured to have a top opening in a manner similar to the first embodiment. However, the air-packing device 201 in the second embodiment has one long flap portion where an end of the flap portion is configured to fit-in the top opening of the air-packing device 201.

Figure 8A:
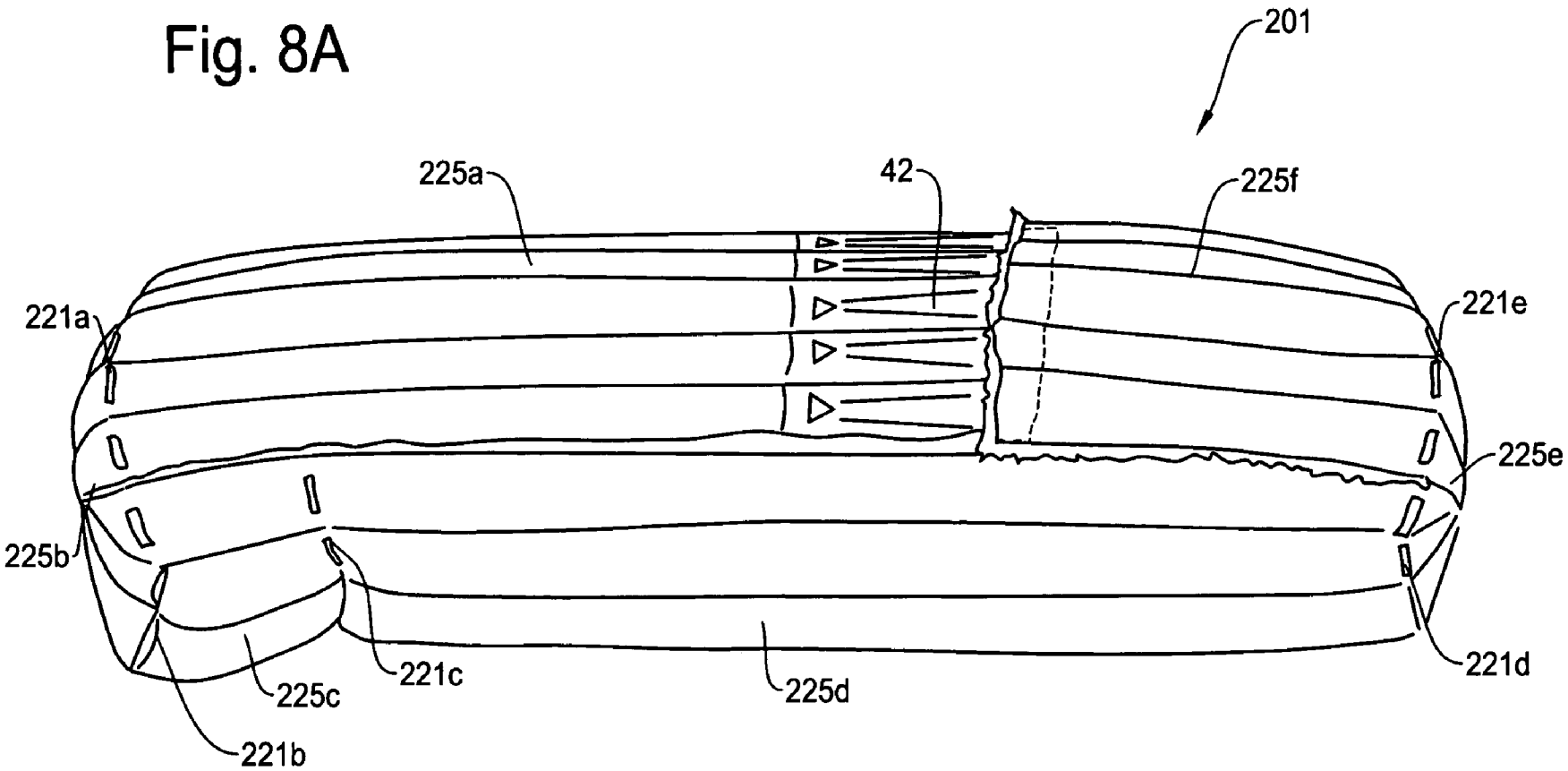
FIGS. 8A-8C are perspective views showing another embodiment of the air-packing device of the present invention where the air-packing device is closed in FIG. 8A, the air-packing device is opened for installing or removing the product in FIG. 8B, and the product is packed in the air-packing device in FIG. 8C.

FIG. 8A is a perspective view showing the second embodiment of the air-packing device of the present invention where the air-packing device 201 is closed. The air-packing device 201 is configured by a plurality of air-containers where each air-container has a plurality of air cells 225*a*-225*f* connected in series. In FIG. 8A, the air-packing device 201 is closed, in FIG. 8B, the air-packing device 201 is opened for installing or removing the product, and in FIG. 8C, a product such as a bottle is packed in the air-packing device 201. In this example, a flap portion for opening and closing the air-packing device 201 is mainly comprised of the air cells 225*a*.

Figure 10:
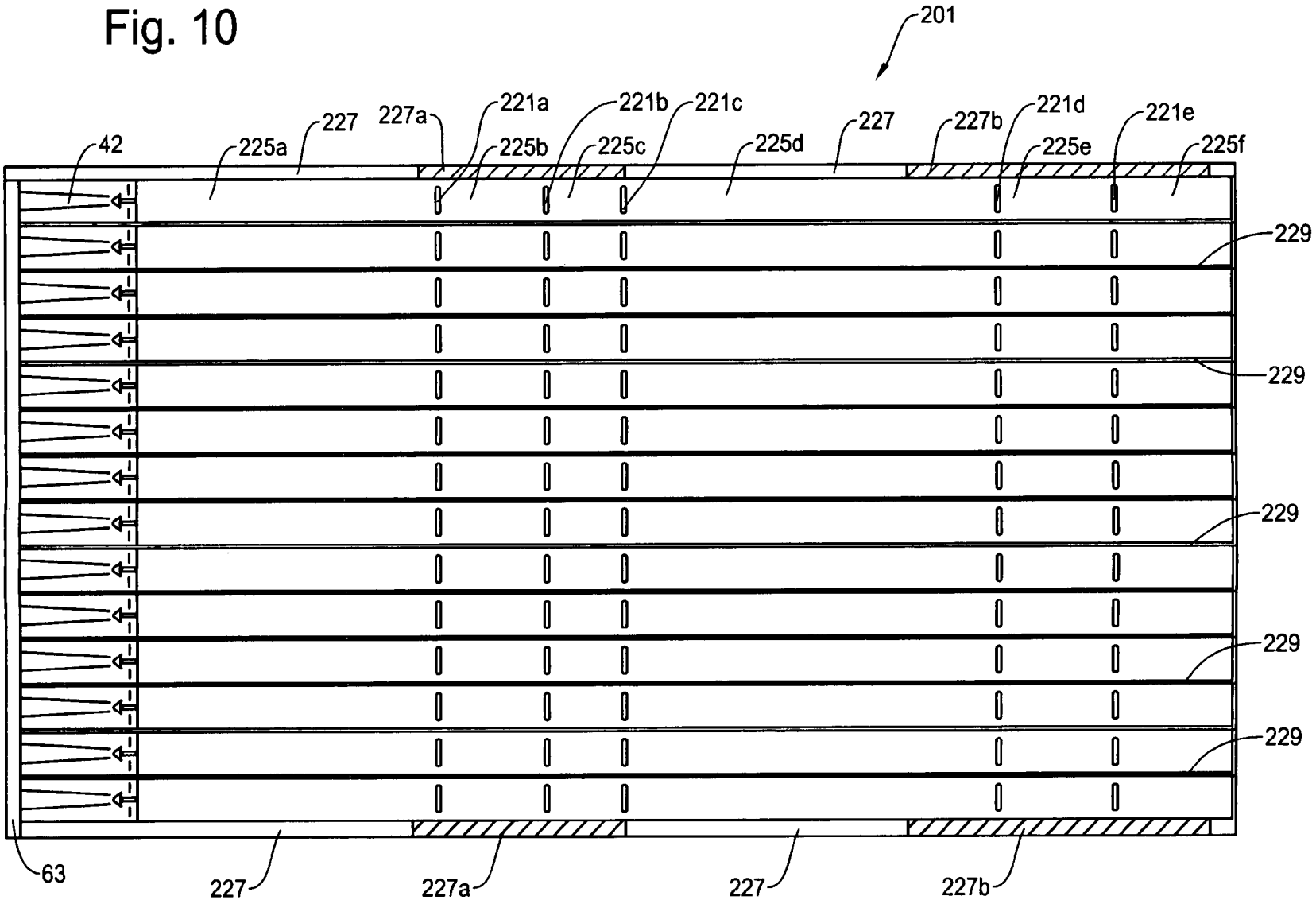
FIG. 10 is a plan view showing a sheet form of the air-packing device of the present invention which is not inflated and is not folded of bonded to form the structure shown in FIGS. 8A-8C and 9.

Typically, the air-packing device 201 is configured by a plurality of air-containers where each air-container has a plurality of air cells 225*a*-225*f* connected in series. The air-packing device 201 is first produced in a sheet like form as shown in FIG. 10 and is folded and bonded through the process of FIGS. 11A-11D. Then, by supplying the compressed air, the air-packing device 201 is inflated to a generally cylindrical shape of FIGS. 8A-8C for packing the product therein.

Figure 8B:
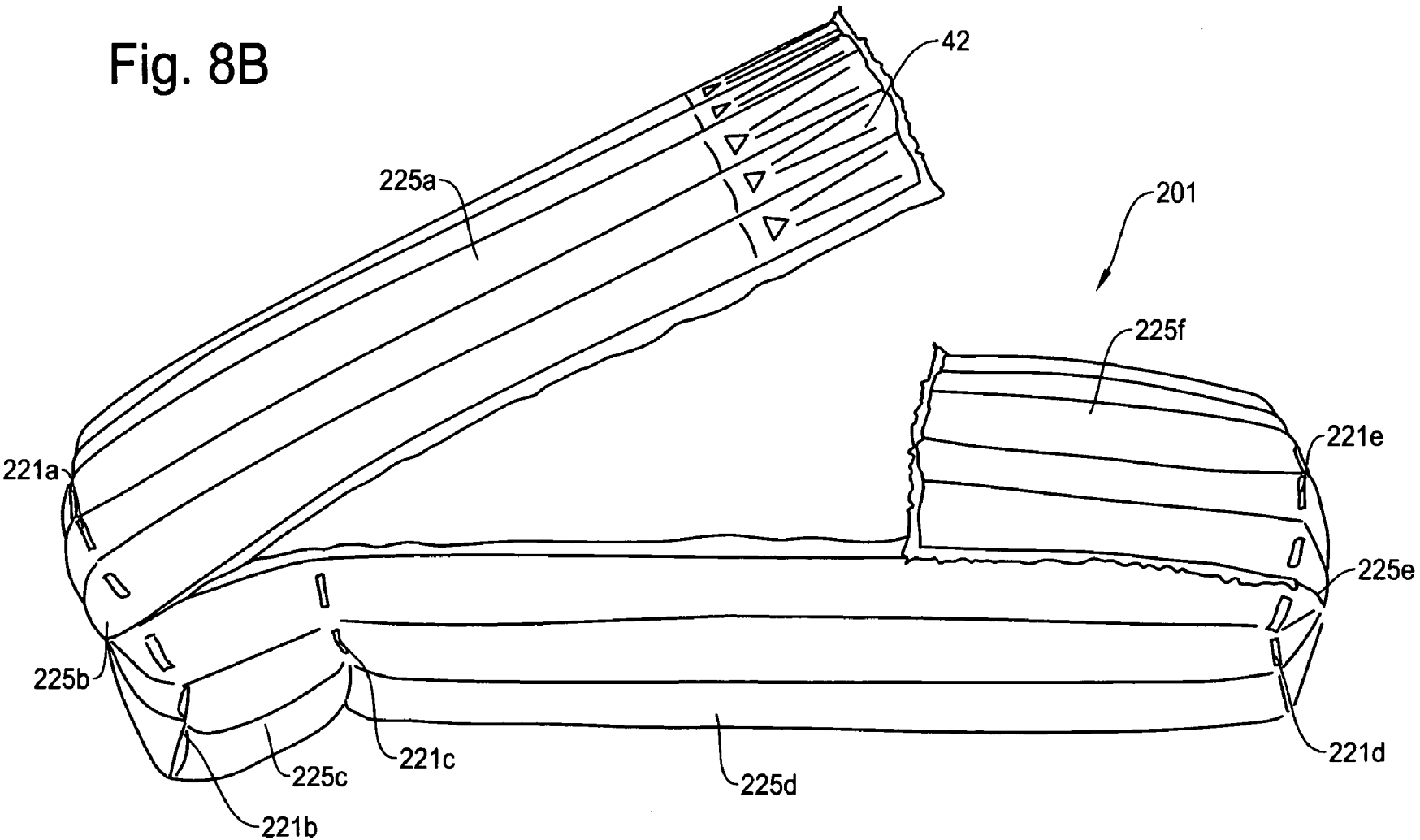
Figure 8C:
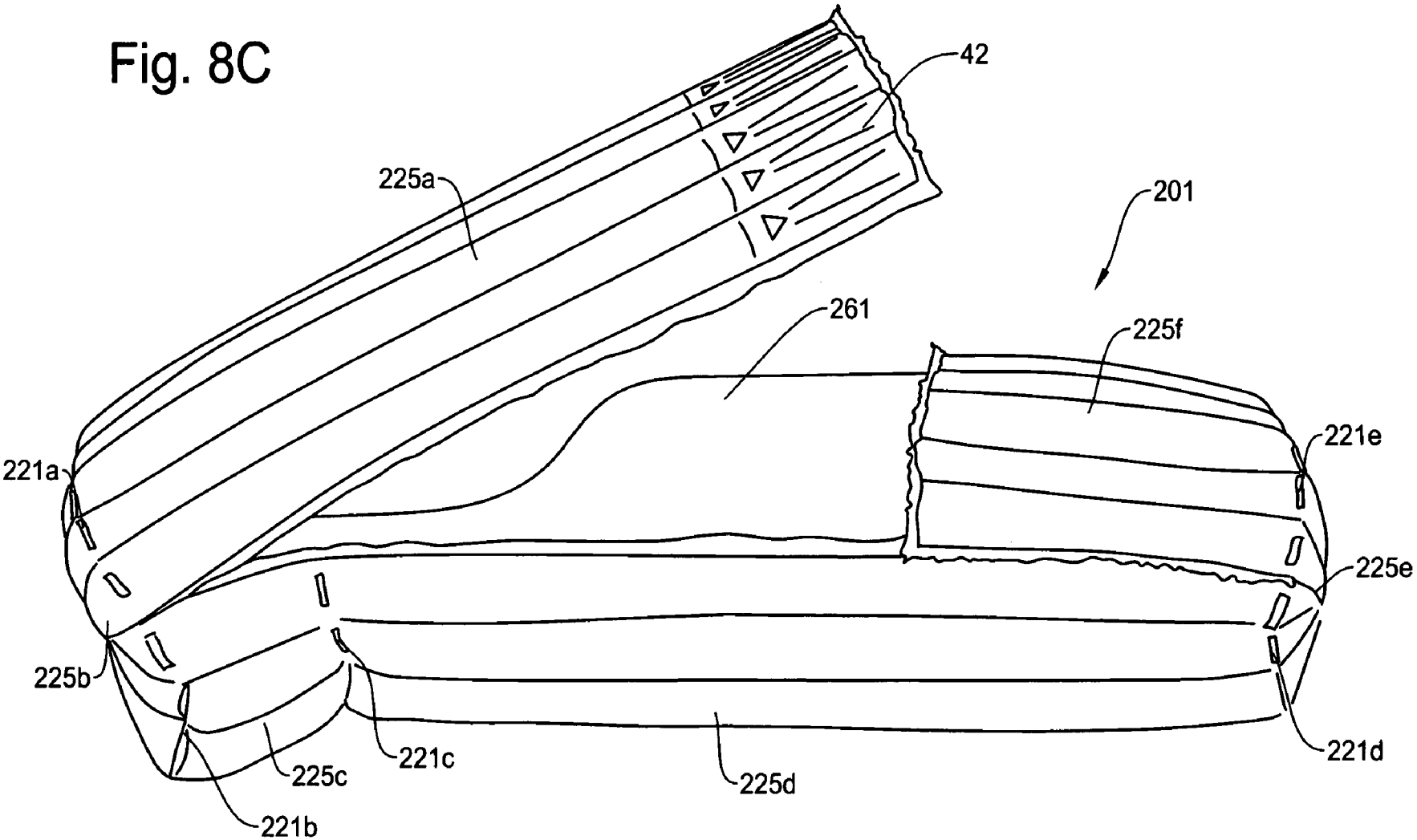

FIG. 10 is a top view showing an example of structure of the second embodiment of the air-packing device 201 in a sheet like form before being folded or inflated to form a three dimensional structure of FIGS. 8A-8C. Similar to the air packing device 101 in the first embodiment described above, the air-packing device 201 is created by bonding the two sheets of thermoplastic films. Each of the thermoplastic films is typically made of three layers of materials: polyethylene, nylon and polyethylene which are bonded together with appropriate adhesive. The nylon is provided between the polyethylene to increase the physical strength of the thermoplastic film.

The two thermoplastic films are bonded (heat-sealed) at separation seals 229, side seals 227, and the heat-seal lands 221 as shown in FIG. 10. The separation seals 229 air-tightly separate the thermoplastic films to create a plurality of air containers 225 each having a check valve 42 and air cells 225*a*-225*f*. In a later heat-seal process for forming the three dimensional structure of the air-packing device, the side seals 227 are further heat-sealed at bonding (heat-seal) areas 227*a* and 227*b* after folding the air-packing device 201 in the manner shown in FIGS. 11A-11D.

In this example, the check valve 42 is formed at the left end of each air container 225 where an air input 63 is commonly connected to all of the check valves 42 to supply the compressed air. The check valve 42 is an air valve that prevents reverse flow of the compressed air. Since the check valve 42 is provided to each air container 225, the air containers 225 of the air-packing device 201 can hold the air (fluid) independently from each other.

A plurality of heat-seal lands 221*a*-221*e* are provided within each air container 225 so that the two thermoplastic films of each air container are bonded to one another. Thus, each of the heat-seal lands 221*a*-221*e* partially blocks the flow of air, although the air can pass through the space at both sides of the heat-seal land 221 within the same air container. As a result, each air container 225 is partially separated by the heat-seal lands 221*a*-221*e* to create a plurality of air cells 225*a*-225*f* which has a sausage like shape when inflated by the compressed air.

Since the two thermoplastic films are bonded at each of the heat-seal lands 221*a*-221*e* so that the thermoplastic films at the heat-seal lands 221*a*-221*e* will not inflate, the heat-seal lands 221*a*-221*e* are used for folding the air packing device 201 to a desired shape. As noted above, since each strip of the air container 225 has its own check valve 42, the air containers 225*a*-225*f* are independent from one another. That is, even if one air container 225 is punctured, the other air containers 225*a*-225*f* are not affected, thereby improving reliability of the air packing device 201. The check valve 42 that can be advantageously implemented in the present invention will be described later in detail with reference to FIGS. 12A-17B.

As noted above, each heat-seal land 221 divides the air container 225 to create a plurality of air cells 225*a*-225*f*. For example, with respect to each air container 225, the heat-seal land 221*a* forms the air cell 225*a*, the heat-seal land 221*b* forms the air cell 225*b*, and the heat-seal land 221*c* forms the air cell 225*c*, and so forth. The sheet like form of the air-packing device 201 shown in FIG. 10 is folded and a heat-seal process is conducted to bond predetermined portions thereof for creating a three dimensional structure of FIGS. 8A-8C.

As shown in FIG. 8B, when the flap portion (air cells 225*a*) is opened, the heat-seal lands 221*c* at the bottom left allow the user to easily bend the air packing device 201 downwardly at the bottom. In this example, since the air cells 225 (flap portion) are long enough to extend from the left end to the right side of the air packing device 201, when in the "open" condition, it creates an elongated opening at the top between the air cells 225 and the air cells 225*f*. As a result, the user can easily insert the product in the air-packing device 201 or remove the product from the air-packing device 201.

FIG. 8C shows the condition where a product to be protected, such as a wine bottle 261, is placed in the inner space of the air-packing device 201. As shown in FIG. 8B, the user can fully open the air-packing device 201 easily by opening the air cells 225*a* while downwardly bending the bottom left portion (heat-seal lands 221*c*) to install the bottle 261. Then, the flap portion comprising the air cells 225*a* is closed as shown in FIG. 8C.

Preferably, the flap portion (air cells 225*a*) is designed to be long enough such that an end thereof can come inside of the air-packing device 201 under the air-cells 225*f*. Since the end of the flap portion comes inside of the air-packing device 201, i.e., a part of the air cells 225*a* comes underneath the air cells 225*f*, it is possible to securely pack the product 261 therein. Typically, the air-packing device 201 having the product 261 therein is further installed in a container box, made of hard paper, corrugated fiber board, etc., commonly used in the industry. In this manner, the product 261 is fully protected from the shock and vibration.

Figure 9:
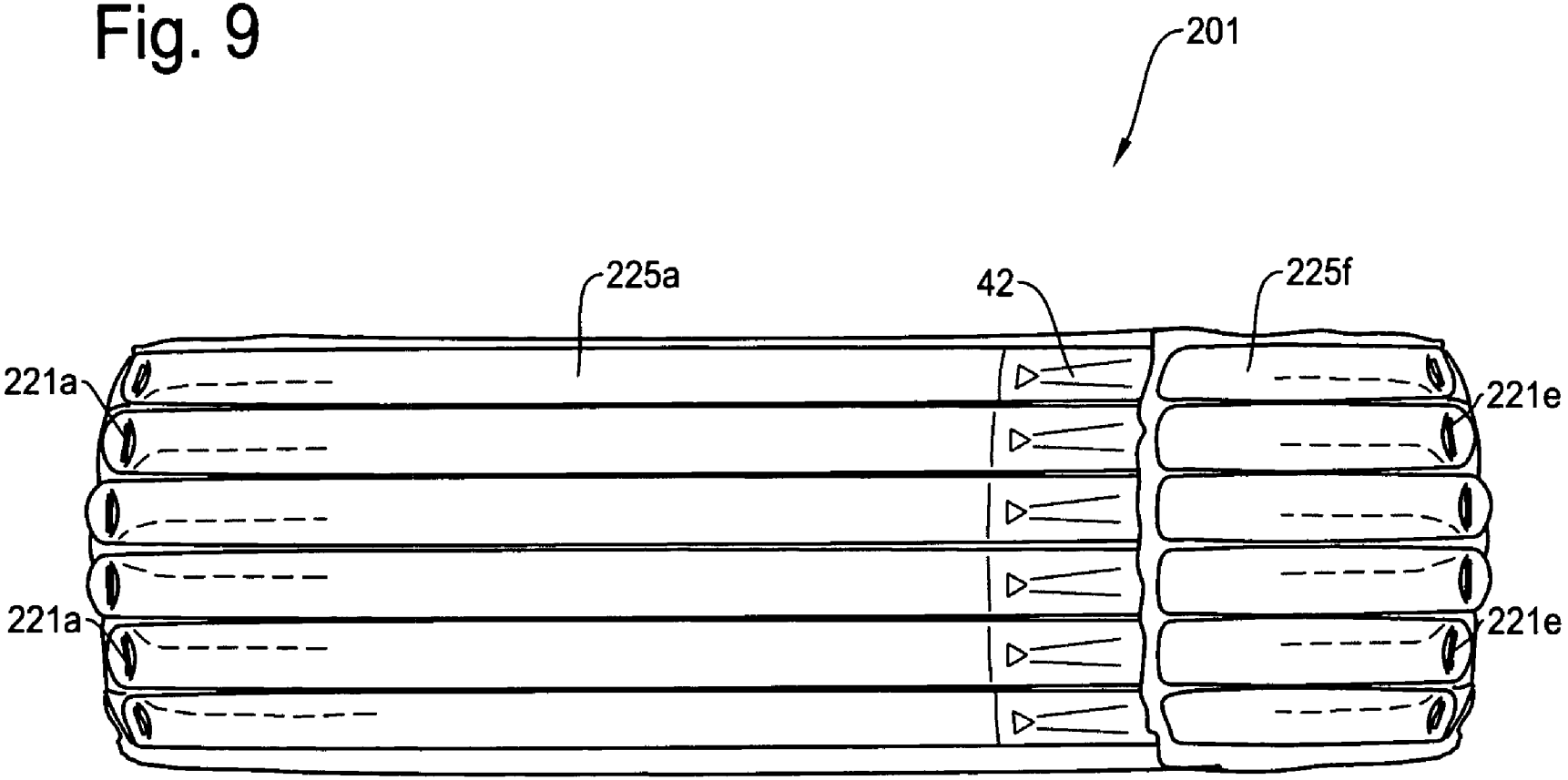
FIG. 9 is a top view showing the outer structure of the embodiment of the air-packing device of FIGS. 8A-8C in accordance with the present invention.

FIG. 9 is a top view showing the inflated air packing device 201 under the present invention. This view shows the condition wherein the flap is closed. As noted above, the right end of the air cells 225*a* is inserted in the top opening, i.e., it is located under the air cells 225*f* to firmly close the air-packing device 201. Compared to the top view shown in FIG. 5A, the air packing device 201 has long sideways with fewer air containers to create the generally cylindrical shape. Moreover, unlike the symmetrical shape of the air-packing device 101 which has a pair of flap portions, only one flap portion made of the air cells 225*a* functions to open and close the air-packing device 201.

As noted above, the sheet like form of the air-packing device 201 shown in FIG. 10 is folded and a heat-seal process is conducted to bond predetermined portions of the air-packing device 201 for creating the three dimensional structure of FIGS. 8A-9. Such a procedure of folding and bonding the sheet of the air-packing device 201 of FIG. 10 is explained with reference to FIGS. 11A-11D. FIGS. 11A-11D are schematic cross sectional front views of the air-packing device 201 before being inflated by the compressed air. In FIGS. 11A-11D, the check valves 42 are omitted for simplicity of illustration.

Figure 11A:
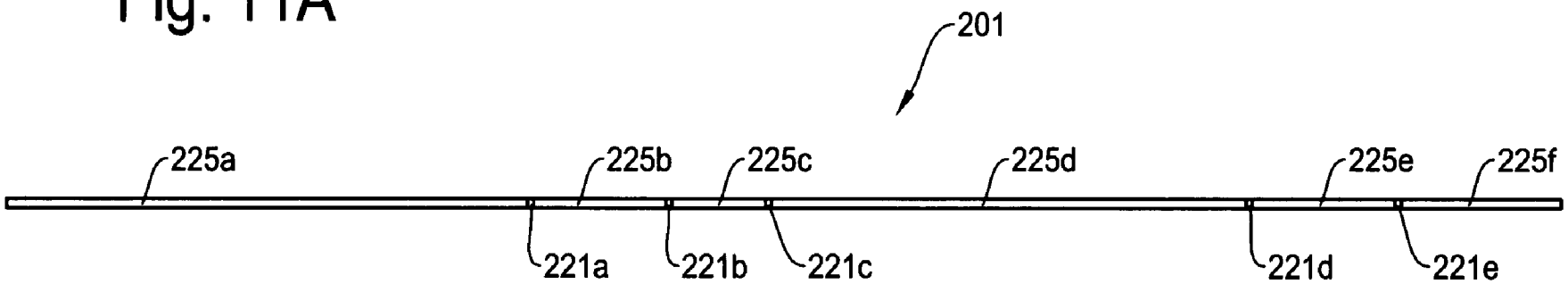
FIGS. 11A-11D are cross sectional front views showing the process for forming the air-packing device from the sheet form shown in FIG. 10 to the form of FIGS. 8A-8C and 9 by folding and bonding the predetermined portions of the air-packing device where the air-packing device in FIGS. 11A-11D is not inflated by the air.
Figure 11B:
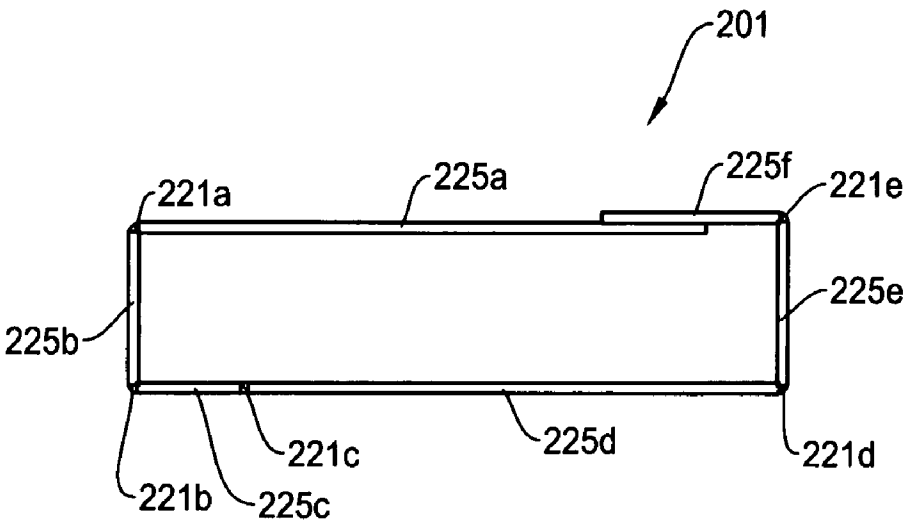

FIG. 11A shows the condition where the sheet form of the air-packing device 201 lies flat. FIG. 11B shows the condition where the air packing device 201 is folded at the heat-seal lands 221. In reality, since the air-packing device 201 is not inflated, it can be bent in any form without regard to the locations of the heat-seal lands 221. However, it should be noted that, to show the relationship between the folding process and the final structure of the air-packing device 201, shapes (ex. bending points) shown FIGS. 11A-11D are exaggerated.

Figure 11C:
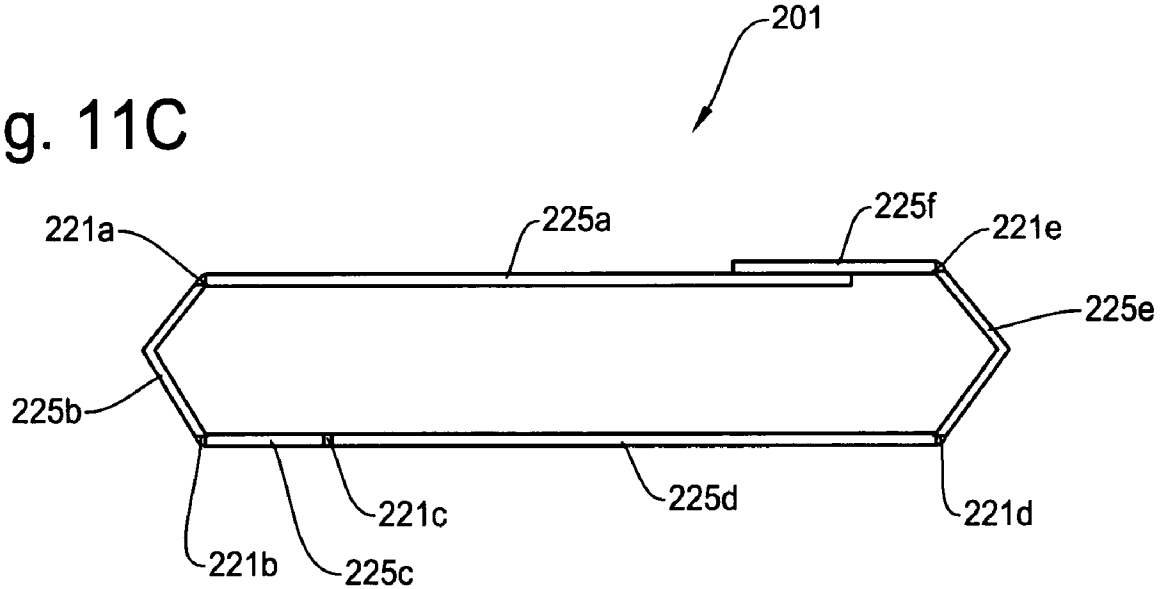
Figure 11D:
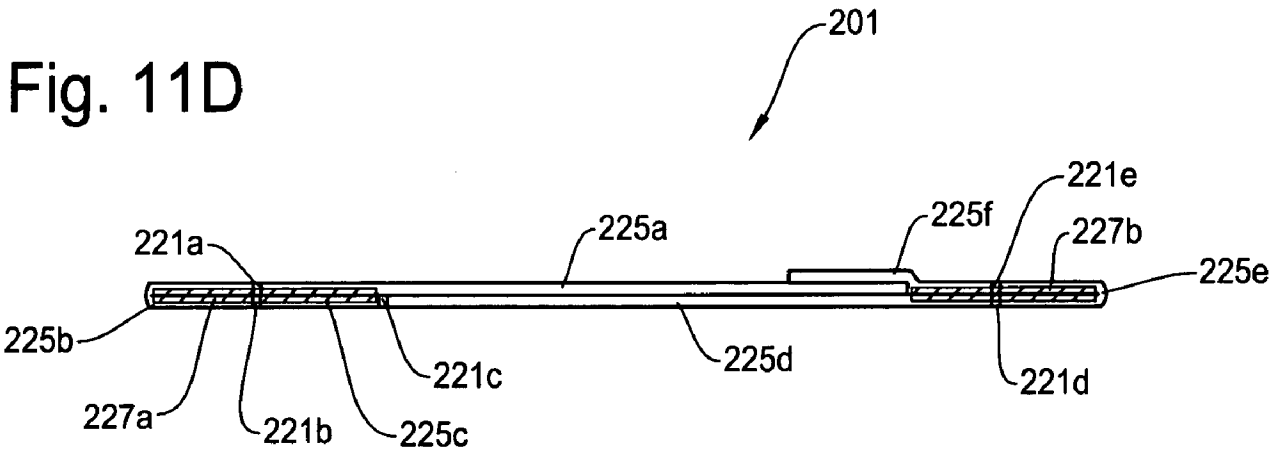

FIG. 11C shows the condition where the air-packing device 201 is further bent at the middle section of the air cells 225*b* and 225*e*. FIG. 11D shows the condition where the air-packing device 201 is completely bent flatly to perform a heat-seal process. When folded in the manner of FIG. 11D, the heat-seal areas 227*a* (see also FIG. 10) at each side of the air-packing device 201 are bonded with each other in such a way that the heat-seal area 227*a* extending along the sidemost air cells 225*b* and 125*c* and a small part of the air cells 225*a* is bonded. Similarly, the heat-seal areas 127*b* (see also FIG. 10) at each side of the air-packing device 201 are bonded with each other in such a way that the heat-seal area 227*b* extending along the sidemost air cells 225*f* and 225*e* and a part of the air cells 225*d* is bonded.

Therefore, a pocket like space is created at each of the left end and the right end of the air-packing device 201. The pocket like space in the left is small since the heat-seal areas 227*a* extends only a small portion of the air cells 225*a*. Therefore, the flap portion formed by the air cells 225*a* is free from the other portions of the air-packing device 201 to easily open and close the air-packing device 201 as shown in FIGS. 8A-8C.

It should be noted that the number of the air containers 225 and the number of air cells 225*a*-225*f* for each air container may vary to better accommodate a particular product to be protected. In the foregoing example, the flap portion (air cells 225*a*) covers all of the product shown in FIG. 8C and the end of the flap portion is locked inside (under the air cells 225*f*) of the air-packing device 201. However, the size, length, and shape of the flap portion (air cells 225*a*) for forming the top opening can be changed depending on the size and shape of the product to be protected.

Figure 12A:
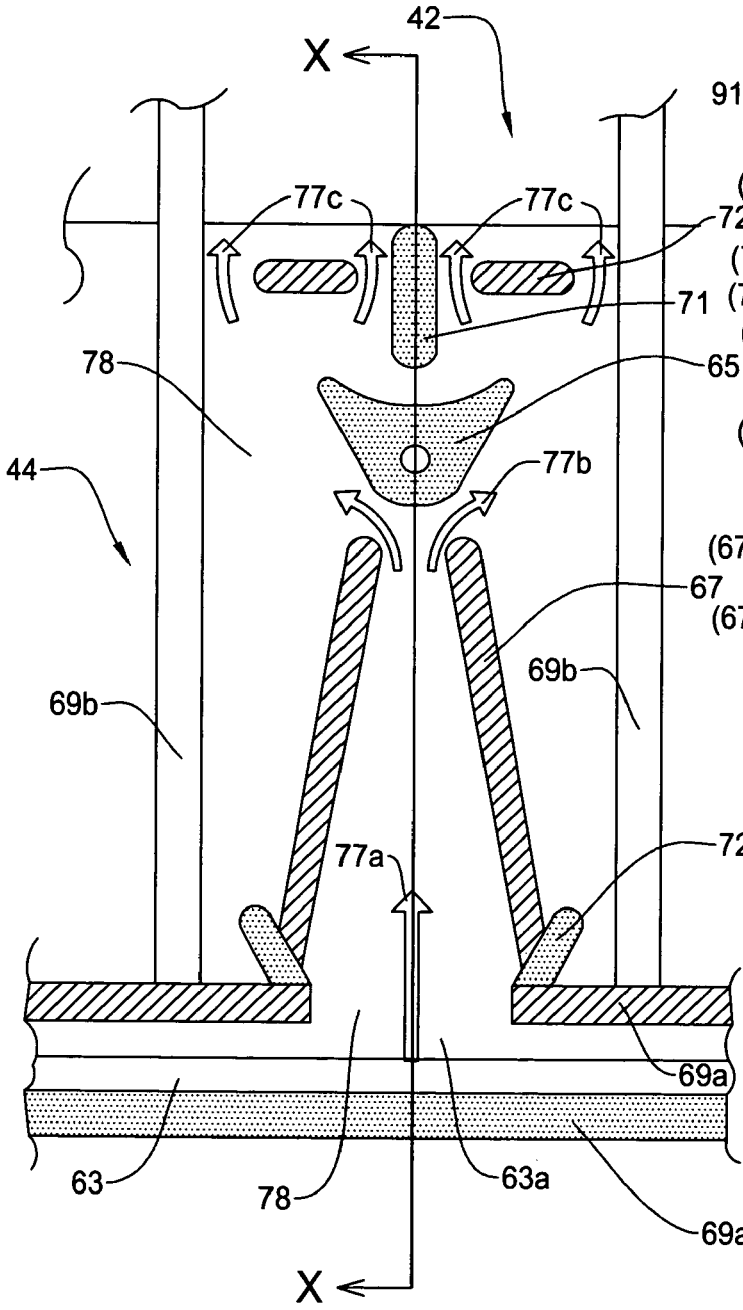
FIGS. 12A-12B are diagrams showing an example of detailed structure and operation of the check-valve in the present invention where
Figure 12B:
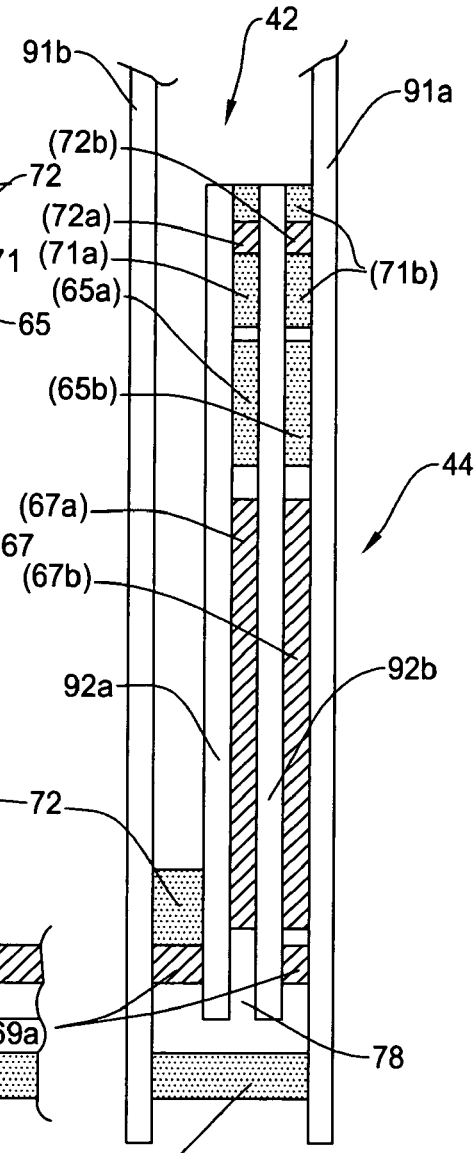
Figure 13:
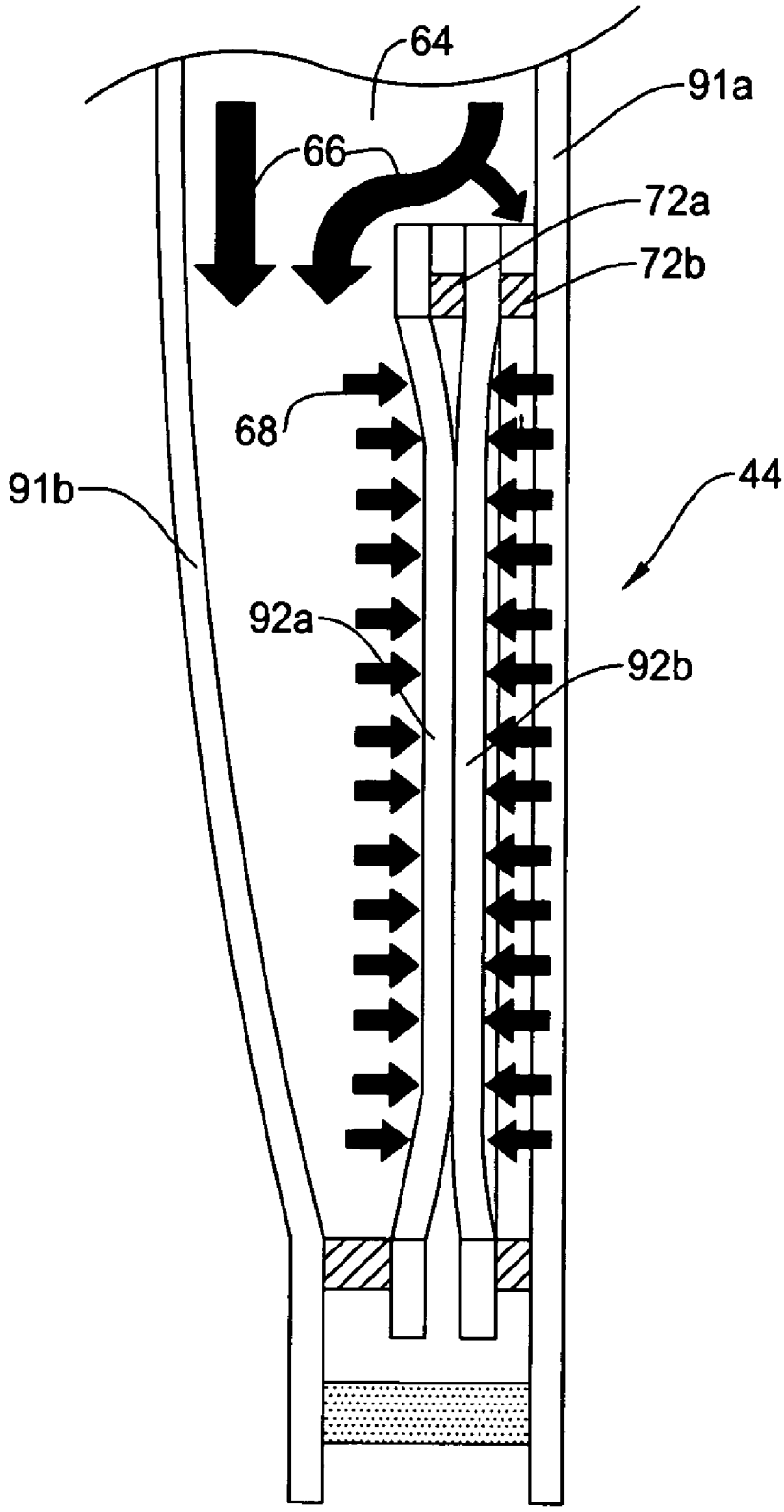
FIG. 13 shows a cross sectional side view of the air-packing device at the portion of the check valve for explaining the operation of the check valve.

FIGS. 12A-12B show example of structure of a check valve that can be implemented in the present invention. In FIGS. 12A-12B, the check valve is denoted by a numeral 44 and the air container is denoted by a numeral 42. FIG. 12A is a top view of the check valve 44, FIG. 12B is a cross sectional side view of the check valve 44 taken along the line X-X in FIG. 12A when the compressed air is not supplied to the air-packing device, and FIG. 13 is a cross sectional side view of the check valve 44 when the compressed air is supplied to the air-packing device.

In the example of FIGS. 12A and 12B, reinforcing seal portions 72 are formed near a check valve inlet 63*a*. These portions are placed in a manner of contacting each edge of the inlet portion 63*a*. The seal portions 72 are provided to reinforce a boundary between the guide passage 63 and the air container 42 so as to prevent the air container from a rupture when it is inflated. In the check valve 44 of the present invention, the reinforcing seal portions 72 are preferable but not essential and thus can be omitted.

In the air-packing device, the two check valve films 92*a* and 92*b* are juxtaposed (superposed) and sandwiched between the two air-packing films 91*a* and 91*b* near the guide passage 63, and fixing seal portions 71-72, 65 and 67. The fixing seal portions 71-72 are referred to as outlet portions, the fixing seal portion 65 is referred to as an extended (or widened) portion, and the fixing seal portion 67 is referred to as a narrow down portion. These fixing seal portions also form the structure of the check valve 44 and fix the valve to the first air-packing film 91*a* at the same time. The fixing seal portions 65 are made by fusing the check valve films 92*a* and 92*b* only with the first air-packing film 91*a*.

The check valve 44 is made of the two check valve films (thermoplastic films) 92*a*-92*b* by which an air pipe (passage) 78 is created therebetween. How the air passes through the check valve 44 is shown by arrows denoted by the reference numbers 77*a*, 77*b* and 77*c* in FIG. 12A. The compressed air is supplied from the guide passage 63 through the air pipe 78 to the air container 42.

In the check valve 44, the regular air relatively easily flows through the air pipe 78 although there exist the fixing seal portions 65, 67 and 71-72. However, the reverse flow of the air in the valve will not pass through the air pipe 78. In other words, if the reverse flow occurs in the air pipe 78, it is prevented because of a pressure of the reverse flow itself. By this pressure, the two surfaces of check valve films 92*a* and 92*b* which face each other, are brought into tight contact as shown in FIG. 13 as will be explained later.

As has been described, in FIGS. 12A-12B, the fixing seal portions 65, 67 and 71-72 also work for guiding the air to flow in the check valve 44. The fixing seal portions are comprised of the portions 71*a*, 72*a*, 65*a* and 67*a* which bond the two check-valve films 92*a* and 92*b* together, and the portions 71*b*, 72*b*, 65*b* and 67*b* which bond the first air-packing film 91*a* and the first check valve film 92*b* together. Accordingly, the air pipe 78 in the check valve 44 is created as a passage formed between the two check valve films 92*a*-92*b*.

Further in FIG. 12A, the fixing seal portions 67 are composed of two symmetric line segments extended in an upward direction of the drawing, and a width of the air pipe 78 is narrowed down by the fixing seal portions (narrow down portions) 67. In other words, the regular flow can easily pass through the air pipe 78 to the air container 42 when passing through the wide space to the narrow space created by the narrow down portions 67. On the other hand, the narrow down potions 67 tend to interfere the reverse flow from the air containers 42 when the air goes back through the narrow space created by the narrow down portions 67.

The extended portion 65 is formed next to the narrow down portions 67. The shape of the extended portion 65 is similar to a heart shape to make the air flow divert. By passing the air through the extended portion 65, the air diverts, and the air flows around the edge of the extended portion 65 (indicated by the arrow 77*b*). When the air flows toward the air container 42 (forward flow), the air flows naturally in the extended portion 65. On the other hand, the reverse flow cannot directly flow through the narrow down portions 67 because the reverse flow hits the extended portion 65 and is diverted its direction. Therefore, the extended portion 65 also functions to interfere the reverse flow of the air.

The outlet portions 71-72 are formed next to the extended portion 65. In this example, the outlet portion 71 is formed at the upper center of the check valve 44 in the flow direction of the air, and the two outlet portions 72 extended to the direction perpendicular to the outlet portion 71 are formed symmetrically. There are several spaces among these outlet portions 71 and 72. These spaces constitute a part of the air pipe 78 through which the air can pass as indicated by the arrows 77*c*. The outlet portions 71-72 are formed as a final passing portion of the check valve 44 when the air is supplied to the air container 42 and the air diverts in four ways by passing through the outlet portions 71-72.

As has been described, the flows of air from the guide passage 63 to the air containers 42 is relatively smoothly propagated through the check valve 44. Further, the narrow down portions 67, extended portions 65 and outlet portions 71-72 formed in the check valve 44 work to interfere the reverse flow of the air. Accordingly, the reverse flow from the air containers 42 cannot easily pass through the air pipe 78, which promotes the process of supplying the air in the air-packing device.

FIG. 13 is a cross sectional view showing an effect of the check valve 44 of the present invention. This example shows an inner condition of the check valve 44 when the reverse flow tries to occur in the air-packing device when it is sufficiently inflated. First, the air can hardly enter the air pipe 78 because the outlet portions 71 and 72 work against the air such that the reverse flow will not easily enter in the outlet portions. Instead, the air flows in a space between the second air-packing film 91*b* and the second check valve film 92*a* as indicated by the arrows 66, and the space is inflated as shown in FIG. 13. By this expansion, in FIG. 13, the second check valve film 92*a* is pressed to the right, and at the same time, the first check valve film 92*b* is pressed to the left. As a result, the two check valve films 92*a* and 92*b* are brought into tight contact as indicated with the arrows 68. Thus, the reverse flow is completely prevented.

Figure 14A:
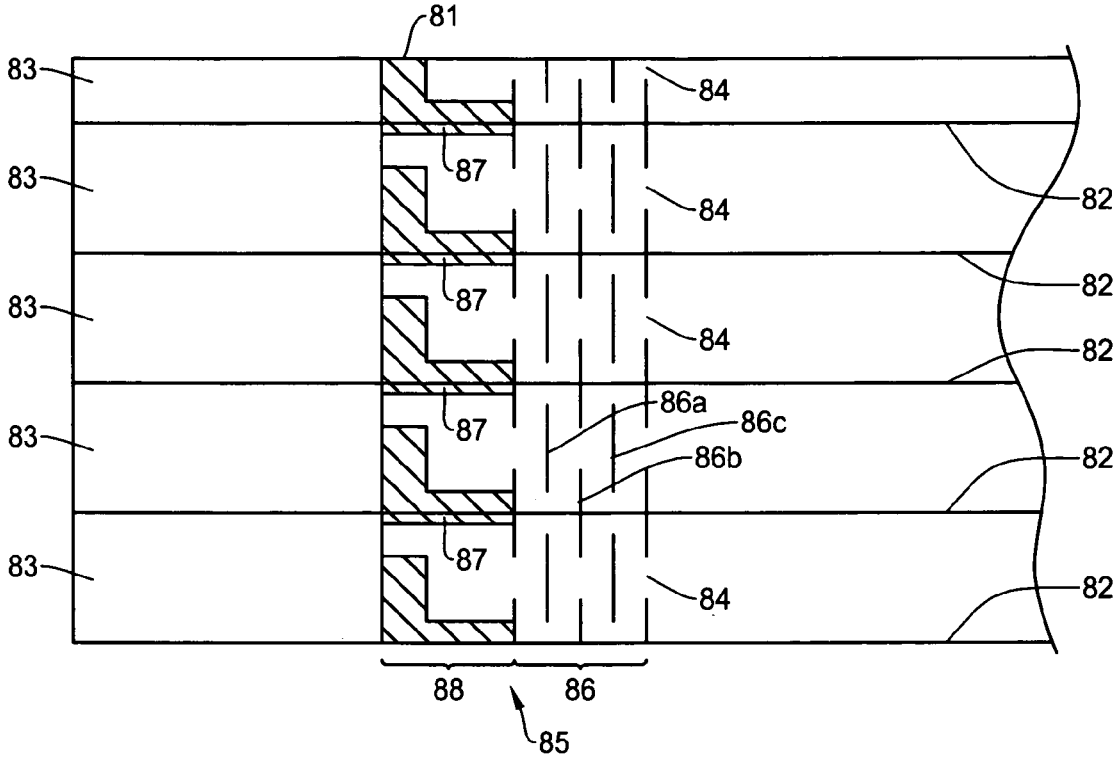
FIGS. 14A-14D show another example of check valve of the present invention where

Another example of the check valve of the present invention is described in detail with reference to FIGS. 14A-14D, 15-16 and 17A-17B in which a check valve is denoted by a reference numeral 85. FIGS. 14A-14D are plan views of the check valve used in the air-packing devices of the present invention. FIG. 14A shows a structure of a check valve 85 and a portion of the air-packing device. The air-packing device having the check valves 85 is comprised of two or more rows of air container each having serially connected air cells 83 which are equivalent to the air cells 125 and 225 in FIGS. 3A-11D. As noted above, typically, each row of air container has a plurality of series connected air cells 83 although only one air cell is illustrated in FIGS. 14A-14D.

Before supplying the air, the air-packing device is in a form of an elongated rectangular sheet made of a first (upper) thermoplastic film 93 and a second (lower) thermoplastic film 94. To create such a structure, each set of series air cells are formed by bonding the first thermoplastic film (air packing film) 93 and the second thermoplastic film (air packing film) 94 by the separation seal (bonding area) 82. Consequently, the air cells 83 are created so that each set of series connected air cells can be independently filled with the air.

Figure 14B:
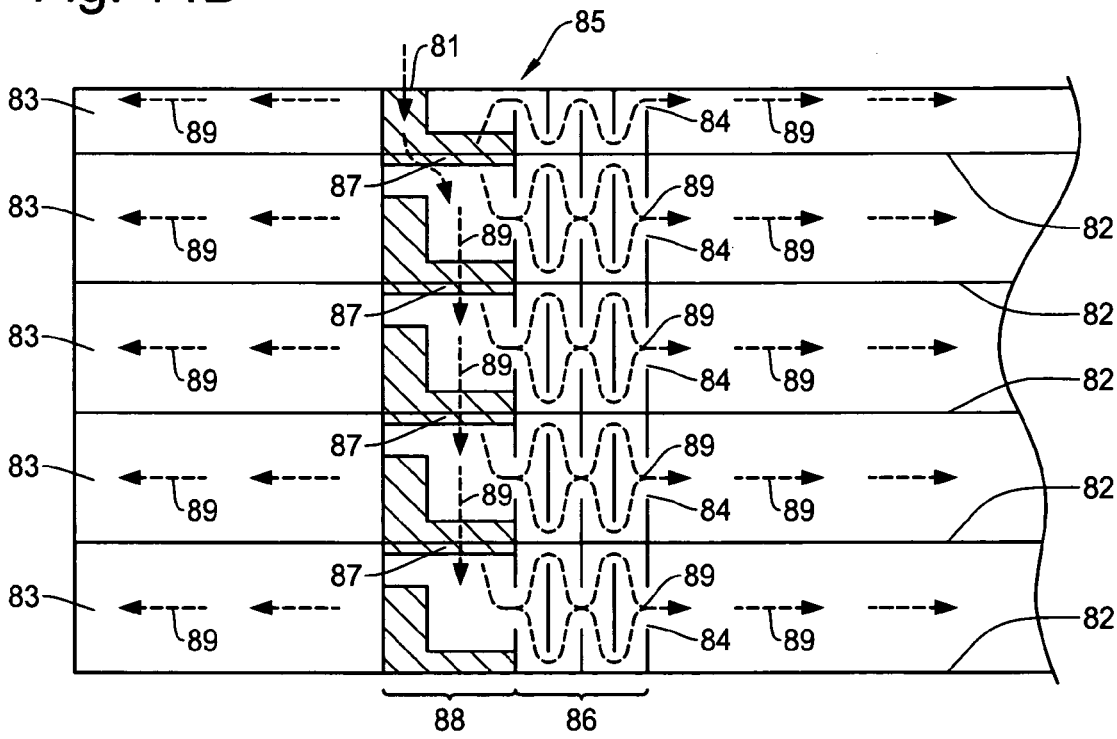
Figure 14C:
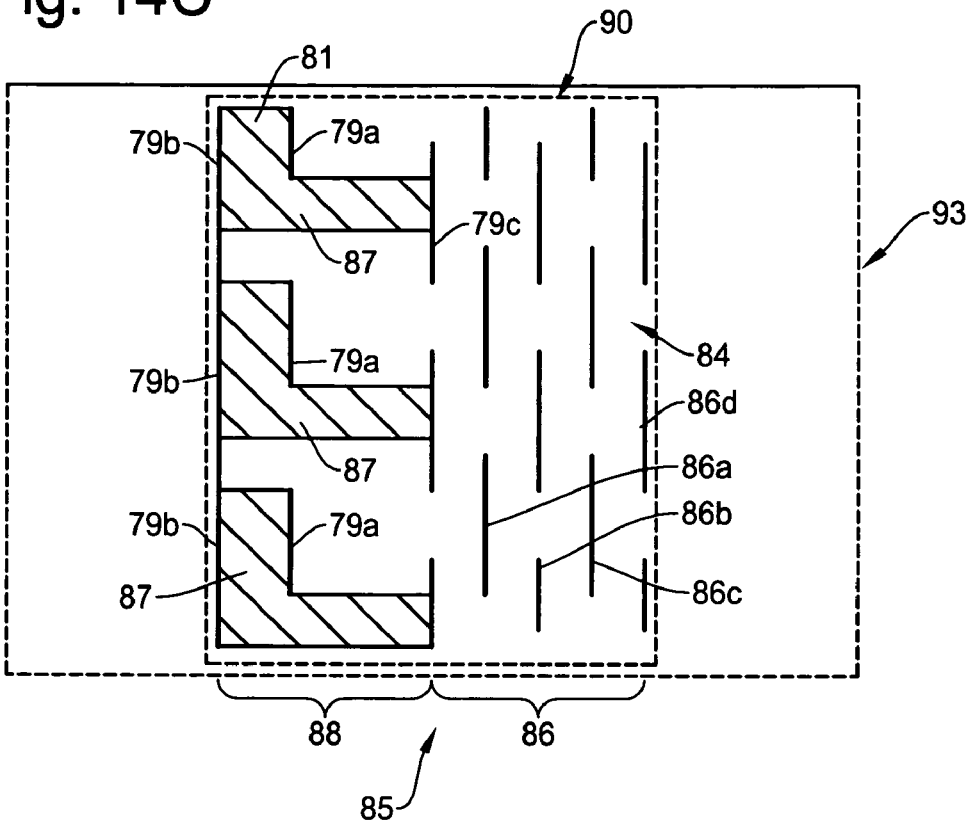

A check valve film 90 having a plurality of check valves 85 is attached to one of the thermoplastic films 93 and 94 as shown in FIG. 14C. When attaching the check valve film 90, peeling agents 87 are applied to the predetermined locations on the separation seals 82 between the check valve film 90 and one of the thermoplastic films 93 and 94. The peeling agent 87 is a type of paint having high thermal resistance so that it prohibits the thermal bonding between the first and second thermoplastic films 93 and 94. Accordingly, even when the heat is applied to bond the first and second thermoplastic films 93 and 94 along the separation seal 82, the first and second thermoplastic films 93 and 94 will not adhere with each other at the location of the peeling agent 87.

The peeling agent 87 also allows the air input 81 to open easily when filling the air in the air-packing device 130. When the upper and lower films 93 and 94 made of identical material are layered together, there is a tendency that both films stick to one another. The peeling agent 87 printed on the thermoplastic films prevents such sticking. Thus, it facilitates easy insertion of an air nozzle of the air compressor into the air inlet 81 when inflating the air-packing device.

The check valve 85 of the present invention is configured by a common air duct portion 88 and an air flow maze portion 86. The air duct portion 88 acts as a duct to allow the flows of the air from the air port 81 to each set of air cells 83. The air flow maze portion 86 prevents free flow of air between the air-packing device 130 and the outside, i.e., it works as a brake against the air flows, which makes the air supply operation easy. To achieve this brake function, the air flow maze portion 86 is configured by two or more walls (heat-seals) 86*a*-86*c*. Because of this structure, the air from the common air duct portion 88 will not straightly or freely flow into the air cells 83 but have to flow in a zigzag manner. At the and of the air flow maze portion 86, an exit 84 is formed.

In the air-packing device incorporating the check valve 85 of the present invention, the compressed air supplied to the air input 81 to inflate the air cells 83 flows in a manner as illustrated in FIG. 14B. The plan view shown in FIG. 14B includes the structure of the check valve 85 identical to that of FIG. 14A and further includes dotted arrows 89 showing the flows of the air in the check valve 85 and the air cells 83. As indicated by the arrows 89, the air from the check valve 85 flows both forward direction and backward direction of the air-packing device. Thus, the check valve 85 can be formed at any locations of the air-packing device. Further, the check valve 85 requires a relatively low pressure of the air compressor when it is attached to an intermediate location of the air-packing device.

In FIG. 14B, when the air is supplied to the air input 81 from the air compressor (not shown), the air flows toward the exit 84 via air duct portion 88 and the air flow maze portion 86 as well as toward the next adjacent air cell 83 via the air duct portion 88. The air exited from the exit 84 inflates the air cell 83 by flowing both forward and backward directions (right and left directions of FIG. 14B) of the air-packing device. The air transferred to the next air cell flows in the same manner, i.e., toward the exit 84 and toward the next adjacent air cell 83. Such operations continue from the first air cell 83 to the last air cell 83. In other words, the air duct portion 88 allows the air to flow to either the present air cell 83 through the air flow maze portion 86 and to the next air cell 83.

Figure 14D:
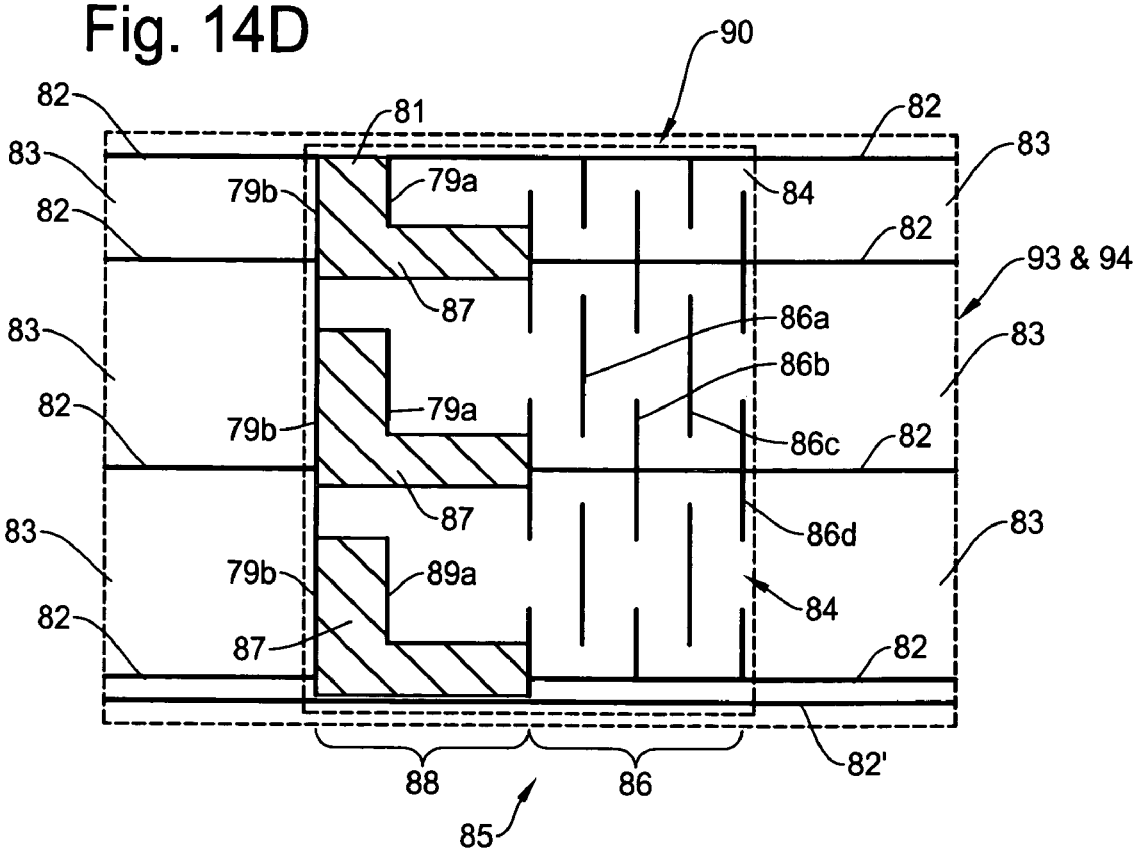

FIGS. 14C-14D show an enlarged view of the check valve of the present invention for explaining how the check valves 85 are created on the air-packing device. As noted above, the check valve film 90 is attached to either one of the thermoplastic film 93 or 94. The example of FIGS. 14C and 14D show the case where the check valve film 90 is attached to the upper (first) thermoplastic film 93. The thick lines in the drawings indicate the heat-seal (bonding) between the thermoplastic films.

The air-packing device of the present invention is manufactured by bonding the second (lower) thermoplastic film 94, the check valve film 90, and the first (upper) thermoplastic film 93 by pressing the films with a heater. Since each film is made of thermoplastic material, they will bond (welded) together when the heat is applied. In this example, the check valve film 90 is attached to the upper thermoplastic film 93, and then, the check valve film 90 and the upper thermoplastic film 93 are bonded to the lower thermoplastic film 94.

First, as shown in FIG. 14C, the check valve film 90 is attached to the upper thermoplastic film 93 by heat-sealing the two films at the portions indicated by the thick lines. Through this process, the peeling agents 87 applied in advance to the check valve film 90 is attached to the upper thermoplastic film 93 by the bonding lines 79*a* and 79*b* to create the air duct portions 88. Further, the air flow maze portions 86 are created by the bonding lines 86*a*-86*c*, etc. At the end of the maze portion 86 is opened to establish the air exit 84.

Then, as shown in FIG. 14D, the check valve film 90 and the upper thermoplastic film 93 are attached to the lower thermoplastic film 94 by heat-sealing the upper and lower films at the portions indicated by the thick lines 82. Through this process, each air cell 83 is separated from one another because the boundary between the two air cells is closed by the sealing line (boundary line) 82. However, the range of the sealing line 82 having the peeling agent 87 is not closed because the peeling agent prohibits the heat-sealing between the films. As a result, the air duct portion 88 is created which allows the air to flow in the manner shown in FIG. 14B.

Figure 15:
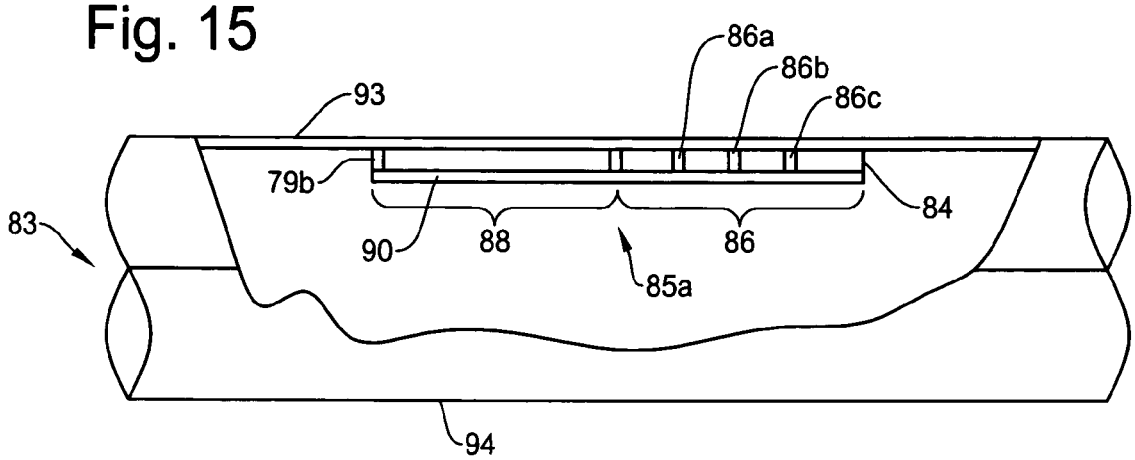
FIG. 15 is a cross sectional view showing an example of inner structure of the check valve in the present invention configured by a single layer film and formed on one of the thermoplastic films of the air-packing device.

FIG. 15 is a partial cross sectional front view showing an example of inner structure of the check valve 85*a* of the present invention configured by a single layer film and formed on a thermoplastic film of the air-packing device. As described in the foregoing, the common air duct portion 88 and the air flow maze portion 86 are created between the check valve film 90 and one of the upper and lower thermoplastic films 93 and 94. In this example, the check valve film 90 is attached to the upper thermoplastic film 93 through the heat-sealing in the manner described with reference to FIG. 14C.

The air flow maze portion 86 has a maze structure such as a zig-zaged air passage to cause resistance to the air flow such as reverse flow. Such a zig-zaged air passage is created by the bonding (heat-sealed) lines 86*a*-86*c*. Unlike the straight forward air passage, the maze portion 86 achieves an easy operation for inflating the air-packing device by the compressed air. Various ways for producing the resistance of the air flow are possible, and the structure of the maze portion 86 shown in FIGS. 14A-14D and 15 is merely one example. In general, the more complex the maze structure, the less area of the maze portion 86 is necessary to adequately produce the resistance against the air flow.

Figure 16:
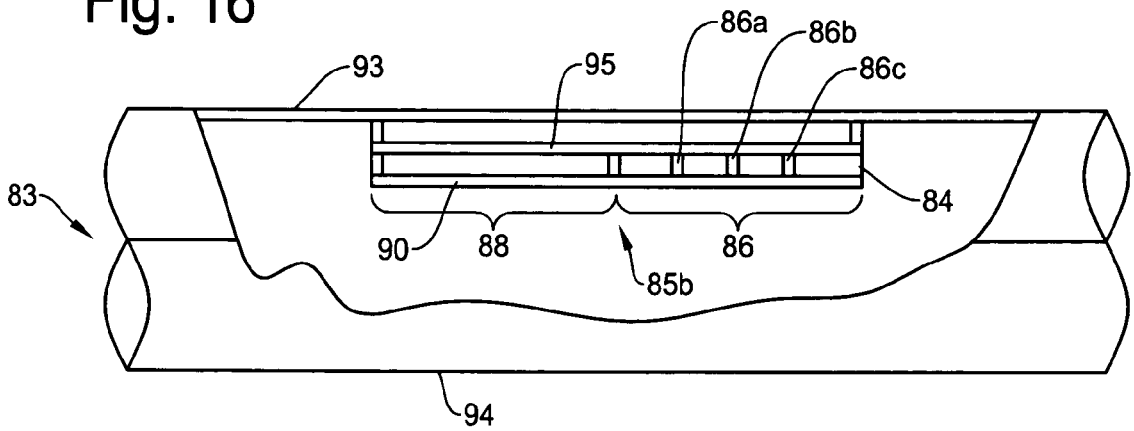
FIG. 16 is a cross sectional view showing another example of the inner structure of the check valve in the present invention configured by double layer films and formed on one of the thermoplastic films of the air-packing device.

FIG. 16 is a cross sectional view showing another example of the inner structure of the check valve 85*b* in the present invention configured by double layer films and formed on one of the thermoplastic films of the air-packing device. In this example, an addition film 95 is provided between the upper thermoplastic film 93 and the check valve film 90. The additional film 95 and the check valve film 90 forms the check valves 85*b*. The additional film 95 is so attached to the upper thermoplastic film 93 that the space between the upper thermoplastic film 93 and the additional film 95 will not transmit air.

The advantage of this structure is the improved reliability in preventing the reverse flows of air. Namely, in the check valve of FIG. 15, when the air is filled in the air cell 83, the upper thermoplastic film 93 of the air cell having the check valve 85 is curved. Further, when a product is loaded in the air-packing device, the surface projection of the product may contact and deform the outer surface of the air cell having the check valve therein. The sealing effect created by the check valve can be weakened because of the curvature of the air cell. The additional film 95 in FIG. 16 mitigates this problem since the film 95 is independent from the upper thermoplastic film 93.

Figure 17A:
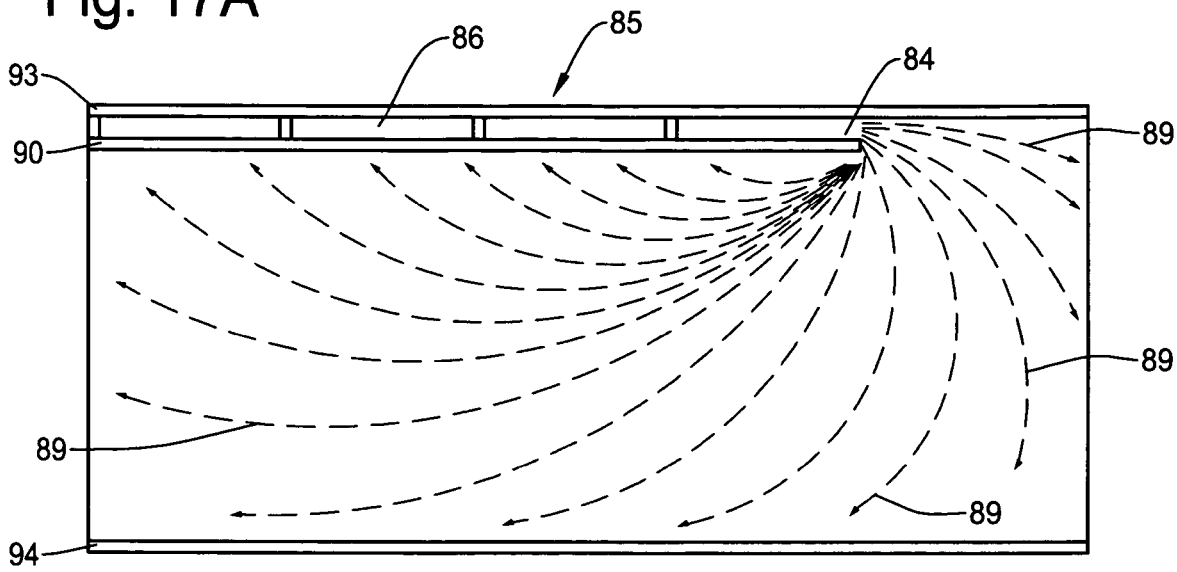
FIGS. 17A and 17B are cross sectional views showing the inner structure of a check valve of the present invention where
Figure 17B:
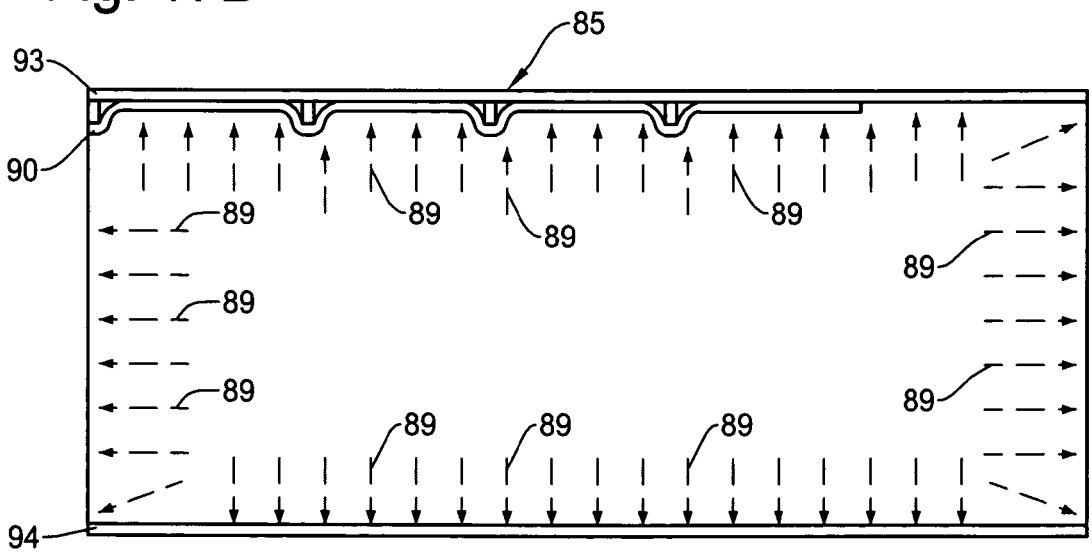

FIGS. 17A and 17B are cross section views showing the inside of the air cell having the check valve 85. FIG. 17A shows the condition wherein the compressed air is being introduced into the air-packing device through the check valve 85. FIG. 17B shows the condition where the air-packing device is filled with air to an appropriate degree so that the check valve 85 is operated to effectively close by the inside air pressure. The dotted arrows 89 indicate the flow of air in FIGS. 17A and 17B.

As shown in FIG. 17A, when the air is pumped in from the air input 81 (FIGS. 14A-14B), the air will flow toward each air cell. While a part of the air flows toward the next row of air cells, the remaining air goes into the present air cell to inflate the air cell. The air will flow into the air cell due to the pressure applied from the air source such as an air compressor. The air goes through the air flow maze portion 86 and exits from the exit 84 at the end of the maze portion 86. All of the air cells will eventually be filled with the compressed air.

As shown in FIG. 17B, when the air cell having the check valve 85 is inflated to a certain extent, the inner pressure of the air will push the check valve film 90 upward so that it touches the upper thermoplastic film 93. FIG. 17B mainly shows the air flow maze portion 86 of the check valve 85 to show how the check valve 85 works. When the inner pressure reaches a sufficient level, the check valve film 90 air-tightly touches the upper thermoplastic film 93, i.e., the check valve 85 is closed, thereby preventing the reverse flows of the air.

As has been described above, according to the present invention, the air-packing device can minimize the shocks or vibrations to the product when the product is dropped or collided. The air-packing device is comprised of multiple rows of air containers each having a plurality of air cells connected in series. After being inflated by the compressed air, the air-packing device is folded, thereby creating a unique structure which is designed to protect the product.

As has been described above, the air-packing device of the present invention forms a flap portion that allows a user to easily enlarge the opening of the air-packing device for placement and removal of the package to be protected. The structure of the air-packing device under the present invention allows to securely hold the package in the air-packing device. Reliability is improved due to check valves that are provided to each air container.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. An air-packing device inflatable by compressed air for protecting a product therein, comprising:

first and second thermoplastic films superposed with each other where predetermined portions of the first and second thermoplastic films are bonded, thereby creating a plurality of air containers;

a plurality of heat-seal lands each sealing the first and second thermoplastic films in a small area of the air container in a manner to allow air flow between the air cells, thereby creating a plurality of series connected air cells for each air container;

a plurality of check valves for corresponding air containers established between the first and second thermoplastic films for allowing the compressed air to flow in a forward direction; and an air input commonly connected to the plurality of check valves to supply the compressed air to the air cells through the check valves;

wherein the air-packing device includes a body portion extending in a longitudinal direction and two flap portions at each end, the flap portions overlapping with the body portion, each flap portion including a first section extending from the body portion and a second section extending from the first section, wherein each flap portion including side edges extending in the longitudinal direction, the side edges of the first section being bonded to the body portion and the side edges of the second section being separate from the body portion.

2. An air-packing device as defined in claim 1, wherein the air-packing device is capable of being bent at heat-seal lands at the bottom of the air-packing device, thereby to open a top opening for installing a product therein or removing the product therefrom.

3. An air-packing device as defined in claim 1, wherein the air-packing device made of the first and second thermoplastic films with the air containers and air cells is first produced in a sheet like form, and is then folded in a predetermined manner and bonded at predetermined locations to create a three dimensional shape for packing a particular product therein.

4. An air-packing device as defined in claim 1, wherein each of the heat-seal lands which heat-seals the first and second thermoplastic films is formed within the air container to define the air cells, the heat-seal lands are folding points when the air-packing device is inflated by the compressed air.

5. An air-packing device as defined in claim 4, wherein each of the heat-seal lands creates two air flow passages at both sides thereof in the air container thereby allowing the compressed air to flow to the series connected air cells through the two air passages.

6. An air-packing device inflatable by compressed air for protecting a product therein, comprising:

first and second thermoplastic films superposed with each other where predetermined portions of the first and second thermoplastic films are bonded, thereby creating a plurality of air containers;

a plurality of heat-seal lands each sealing the first and second thermoplastic films in a small area of the air container in a manner to allow air flow between the air cells, thereby creating a plurality of series connected air cells for each air container;

a plurality of check valves for corresponding air containers established between the first and second thermoplastic films for allowing the compressed air to flow in a forward direction;

an air input commonly connected to the plurality of check valves to supply the compressed air to the air cells through the check valves; and wherein the air-packing device includes a body portion extending in a longitudinal direction and two flap portions at each end, the flap portions overlapping with the body portion, each flap portion including side edges extending in the longitudinal direction, the flap portion at one end including at least a portion that has side edges bonded to the body portion and the flap portion at the other end including at least a portion that is separate from the body portion.

7. An air-packing device as defined in claim 6, wherein the air-packing device is capable of being bent at the heat-seal lands at the bottom of the air-packing device to open a top opening for installing a product therein or removing the product therefrom.

8. An air-packing device as defined in claim 6, wherein the air-packing device made of the first and second thermoplastic films with the air containers and air cells is first produced in a sheet like form, and is then folded in a predetermined manner and bonded at predetermined locations to create a three dimensional shape for packing a particular product therein.

9. An air-packing device as defined in claim 6, wherein each of the heat-seal lands which heat-seals the first and second thermoplastic films is formed within the air container to define the air cells, the heat-seal lands are folding points when the air-packing device is inflated by the compressed air.

10. An air-packing device as defined in claim 9, wherein each of the heat-seal lands creates two air flow passages at both sides thereof in the air container thereby allowing the compressed air to flow to the series connected air cells through the two air passages.

11. An air-packing device as defined in claim 1, wherein the check valve includes sealed portions which are fixed to one of thermoplastic films forming the air-packing device, wherein the sealed portions include:

an inlet portion which introduces the air into the check valve;

a pair of narrow down portions creating a narrow down passage connected to the inlet portion;

an extended portion which diverts the air flows coming through the narrow down passage; and a plurality of outlet portions which introduce the air from the extended portion to the air container.

12. An air-packing device as defined in claim 11, wherein reinforcing seal portions are formed close to the inlet portion to reinforce the bonding between the check valve and one of the first and second thermoplastic films.

13. An air-packing device as defined in claim 6, wherein the check valve includes sealed portions which are fixed to one of thermoplastic films forming the air-packing device, wherein the sealed portions include:

an inlet portion which introduces the air into the check valve;

a pair of narrow down portions creating a narrow down passage connected to the inlet portion;

an extended portion which diverts the air flows coming through the narrow down passage; and a plurality of outlet portions which introduce the air from the extended portion to the air container.

14. An air-packing device as defined in claim 13, wherein reinforcing seal portions are formed close to the inlet portion to reinforce the bonding between the check valve and one of the first and second thermoplastic films.

15. An air-packing device as defined in claim 1, wherein the check valve is comprised of:

a check valve film on which peeling agents of predetermined pattern are printed, the check valve film being attached to one of first and second thermoplastic films forming the air-packing device;

an air input established by one of the peeling agents on the air-packing device for receiving an air from an air source;

an air flow maze portion forming an air passage of a zig-zag shape, the air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells;

wherein heat-sealing between the first and second thermoplastic films for separating two adjacent air containers is prevented in a range where the peeling agent is printed.

16. An air-packing device as defined in claim 15, wherein at least the air passage in the air flow maze portion is closed by air tightly contacting the check valve film with one of the first and second thermoplastic films by the air pressure within the air cell when the air-packing device is filled with the compressed air.

17. An air-packing device as defined in claim 6, wherein the check valve is comprised of:

a check valve film on which peeling agents of predetermined pattern are printed, the check valve film being attached to one of first and second thermoplastic films forming the air-packing device;

an air input established by one of the peeling agents on the air-packing device for receiving an air from an air source;

an air flow maze portion forming an air passage of a zig-zag shape, the air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells;

wherein heat-sealing between the first and second thermoplastic films for separating two adjacent air containers is prevented in a range where the peeling agent is printed.

18. An air-packing device as defined in claim 17, wherein at least the air passage in the air flow maze portion is closed by air tightly contacting the check valve film with one of the first and second thermoplastic films by the air pressure within the air cell when the air-packing device is filled with the compressed air.

19. An air-packing device as defined in claim 1, wherein one of the flap portions extends a sufficient length to reach the other flap portion.

20. An air-packing device as defined in claim 6, wherein one of the flap portions extends a sufficient length to reach the other flap portion.

* * * * *